US009522776B2

(12) United States Patent
Kawate

(10) Patent No.: US 9,522,776 B2
(45) Date of Patent: Dec. 20, 2016

(54) FLUID CONTAINER

(71) Applicant: SEIKO EPSON CORPORATION, Tokyo (JP)

(72) Inventor: Hiroyuki Kawate, Hokuto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/645,062

(22) Filed: Mar. 11, 2015

(65) Prior Publication Data

US 2015/0259130 A1 Sep. 17, 2015

(30) Foreign Application Priority Data

Mar. 14, 2014 (JP) ..... 2014-051792
Mar. 14, 2014 (JP) ..... 2014-051794

(51) Int. Cl.
*B65D 83/38* (2006.01)
*B41J 2/175* (2006.01)

(52) U.S. Cl.
CPC ..... *B65D 83/38* (2013.01); *B41J 2/17526* (2013.01)

(58) Field of Classification Search
CPC ..... B41J 2/1752; B41J 2002/17516
See application file for complete search history.

(56) References Cited

U.S. PATENT DOCUMENTS 4,804,119 A * 2/1989 Goodall ..... B65D 1/12 215/383
4,848,602 A * 7/1989 Yoshimura ..... B41J 2/175 141/286
5,500,664 A * 3/1996 Suzuki ..... B41J 2/17513 347/86
6,170,937 B1 * 1/2001 Childers ..... B41J 2/16538 347/85
6,749,292 B2 * 6/2004 Sturgeon ..... B41J 2/1752 347/45
8,192,003 B2 * 6/2012 Ishizawa ..... B41J 2/17509 347/86
8,231,209 B2 * 7/2012 Koizumi ..... B41J 2/1752 347/84
8,857,956 B2 * 10/2014 Tomoguchi ..... B41J 25/00 347/86

(Continued)

FOREIGN PATENT DOCUMENTS

CN 103203996 A 7/2013
JP 2009-279876 A 12/2009

(Continued)

*Primary Examiner* — Stephen Meier
*Assistant Examiner* — John P Zimmerman
(74) *Attorney, Agent, or Firm* — Stroock & Stroock & Lavan LLP

(57) ABSTRACT

There is provided a technique that achieves the function of connecting a fluid container with a fluid consuming device by using a less number of components. A fluid container detachably connectable with a fluid consuming device comprises a fluid container body configured to contain a fluid; a fluid supply structure located at one end portion of the fluid container body; a container-side electrical connection structure including a contact element that comes into contact with a device-side electrical connection structure provided in the fluid consuming device; and a linkage member including a linkage part configured to link the fluid supply structure with the container-side electrical connection structure and a handle part that is grasped.

15 Claims, 29 Drawing Sheets

(56) References Cited

U.S. PATENT DOCUMENTS

| | | | | |
|---|---|---|---|---|
| 2003/0076390 | A1 | 4/2003 | Sturgeon et al. | |
| 2004/0021737 | A1* | 2/2004 | Harada | B41J 2/17553 347/49 |
| 2005/0036015 | A1* | 2/2005 | Seino | B41J 2/17553 347/86 |
| 2005/0243148 | A1 | 11/2005 | Miyazawa et al. | |
| 2005/0248637 | A1* | 11/2005 | Seino | B41J 2/1752 347/86 |
| 2008/0136878 | A1 | 6/2008 | Nozawa et al. | |
| 2008/0192077 | A1* | 8/2008 | Middleton | B41J 2/155 347/14 |
| 2009/0290001 | A1 | 11/2009 | Domae | |
| 2013/0182050 | A1 | 7/2013 | Aoki et al. | |
| 2013/0182051 | A1 | 7/2013 | Aoki et al. | |
| 2013/0186513 | A1 | 7/2013 | Aoki et al. | |
| 2013/0187993 | A1 | 7/2013 | Aoki et al. | |
| 2013/0194357 | A1 | 8/2013 | Karasawa et al. | |
| 2014/0104351 | A1 | 4/2014 | Aoki et al. | |
| 2014/0340454 | A1 | 11/2014 | Aoki et al. | |
| 2015/0042734 | A1 | 2/2015 | Aoki et al. | |
| 2016/0031224 | A1 | 2/2016 | Aoki et al. | |

FOREIGN PATENT DOCUMENTS

| | | | |
|---|---|---|---|
| JP | 2011-235652 | A | 11/2011 |
| WO | 2004/037541 | A1 | 5/2004 |

* cited by examiner

F13-F13 CROSS SECTIONAL VIEW

VIEWED FROM ARROW F16B

F17Da-F17Da PARTIAL CROSS SECTIONAL VIEW

F17Db-F17Db PARTIAL CROSS SECTIONAL VIEW

F18-F18 PARTIAL CROSS SECTIONAL VIEW

F20-F20 PARTIAL CROSS SECTIONAL VIEW

FLUID CONTAINER

CROSS-REFERENCE TO RELATED APPLICATIONS

The present application claims priority from Japanese Patent Applications No. 2014-51792 and No. 2014-51794 filed on Mar. 14, 2014, the entireties of disclosures of which are hereby incorporated by reference into this application.

BACKGROUND

Technical Field

The present invention relates to a technique relating to a fluid container that is detachably mountable to a fluid consuming device.

Description of the Related Art

A previously known technique for supplying a fluid to a printer as a fluid consuming device is using a fluid container including a fluid container body configured to contain a fluid and a casing configured to place the fluid container body therein (for example, Patent Literature 1: International Patent Publication WO 2004/037541, Patent Literature 2: JP 2009-279876A and Patent Literature 3: JP 2011-235652A). In the disclosure of Patent Literature 1, a fluid container body is placed in a casing configured to be drawable from the printer. In the disclosures of Patent Literatures 2 and 3, a fluid container body is placed in a casing configured to surround and cover the entire fluid container body. A fluid container including the fluid container body and the casing is detachably connected with the fluid consuming device.

A known structure of the fluid container includes a fluid container body, a fluid supply port mounted to a sealed section (sealing polymer section) of the fluid container body and a storage unit provided in a support member (attachment member, adapter) separately provided from the fluid container body (for example, Patent Literatures 1 and 2). A fluid contained in the fluid container body is supplied to the printer (fluid consuming device).

SUMMARY

In the techniques of Patent Literatures 1 to 3 described above, the fluid container body (fluid containing bag) placed in the casing is connected to the fluid consuming device. This configuration may, however, cause various problems described below. For example, when there is a change in size of the fluid container body, in shape of the fluid container body or in amount of a fluid contained in the fluid container body, there may be a necessity to change the size and the shape of the casing accompanied with the change of the fluid container body. In another example, when there is a change in properties of the fluid contained in the fluid container body, there may be a necessity to change the material of the casing according to the properties of the fluid by considering the possibility of leakage of the fluid from the fluid container body. When there is a change in design, for example, a change in shape of a part of the fluid consuming device to which the fluid container body is mounted (cartridge mounting structure), there may be a necessity to change the casing of the fluid container associated with the design change. As described above, when there is a change with respect to a certain part of the fluid container or the fluid consuming device, there may be a necessity to change another part associated with the change of the certain part.

In the technique of Patent Literature 1 described above, the storage unit is attached in a variable manner to the fluid container body at a position away from the fluid supply port. A procedure of connecting the fluid container body to the fluid consuming device mounts the fluid container body in a cartridge casing by taking into account the positions of the fluid supply port and the storage unit and connects the fluid container body to the fluid consuming device using the cartridge casing with the fluid container body mounted therein. This prior art technique may, however, cause the following problems. For example, this may complicate the working process to connect the fluid container body with the fluid consuming device. This may also make it difficult to adjust the positions of the fluid supply port and the storage unit relative to the fluid consuming device, due to the configuration that the fluid supply port and the storage unit are supported on different components. This may also increase the number of components by using the cartridge casing as the separate component.

In the technique of Patent Literature 2 described above, the fluid container has a tray in which the fluid container body is placed, and the fluid container is mounted to the fluid consuming device in the state that the adapter is fixed to the tray. This technique needs the tray to supply the fluid contained in the fluid container body to the fluid consuming device. Accordingly there is a necessity to position the adapter and the tray relative to each other. The technique of Patent Literature 2 may thus cause the problems such as the increased number of components and the complicated working process to manufacture the fluid container. Additionally, in the technique of Patent Literature 2, the adapter is mounted to the fluid container body by pressing a seal member of the fluid container body between a flange member and a stopper of the adapter. In this case, the seal member may be damaged by such pressing, which may lead to leakage of the fluid (for example, ink) contained in the fluid container body.

One object of the invention is thus directed to provide a technique of reducing the number of parts to be changed when there is a change with respect to a certain part of the fluid container or the fluid consuming device. Another object of the invention is to provide a technique of achieving the function of connecting the fluid container with the fluid consuming device by using a less number of components. Another object of the invention is to provide a technique of connecting the fluid container with the fluid consuming device by a simple working process. Other needs with respect to the prior art include cost reduction, resource saving easy manufacture and improvement of usability.

In order to solve at least part of the problems described above, the invention may be implemented by aspects described below.

(1) According to one aspect of the invention, there is provided a fluid container detachably connectable with a fluid consuming device. The fluid container comprises a fluid container body configured to contain a fluid; a fluid supply structure located at one end portion of the fluid container body; a container-side electrical connection structure including a contact element that comes into contact with a device-side electrical connection structure provided in the fluid consuming device; and a linkage member including a linkage part configured to link the fluid supply structure with the container-side electrical connection structure and a handle part that is grasped.

In the fluid container of this aspect, the fluid supply structure and the container-side electrical connection structure are linked with each other by the linkage member including the handle part. This causes the fluid supply structure and the container-side electrical connection structure to be moved in conjunction with the motion of the linkage member when the user holds the handle part to move the linkage member. This facilitates connection of the fluid supply structure with the fluid consuming device and contact of the contact element with the device-side electrical connection structure.

(2) The fluid container of the above aspect may further comprise a joint part joined with the one end portion of the fluid container body. The fluid supply structure may be connected with the joint part, and the linkage member may be linked with the joint part.

The linkage member has the handle part that can be grasped, so that an external force is likely to be applied to the linkage member and a member connected with the linkage member. In the fluid container of this aspect, the linkage member is linked with the joint part. This configuration reduces the likelihood that part of the fluid container body other than the joint part is damaged and thereby reduces the likelihood of leakage of the fluid contained in the fluid container body to outside.

(3) In the fluid container of the above aspect, the fluid supply structure and the linkage member may be formed integrally.

The fluid container of this aspect is readily manufactured. The fluid container of this aspect also enables the fluid supply structure and the container-side electrical connection structure to be positioned relative to each other with high accuracy.

(4) In the fluid container of the above aspect, the fluid supply structure, the container-side electrical connection structure and the linkage member may be formed integrally.

The fluid container of this aspect is more readily manufactured. The fluid container of this aspect also enables the fluid supply structure, the container-side electrical connection structure and the linkage member to be positioned relative to one another with high accuracy.

(5) In the fluid container of the above aspect, the joint part may include a protruded portion protruded outside of the fluid container body. The linkage member may have an engagement element to be engaged with the protruded portion. The linkage member may be linked with the joint part through engagement of the engagement element with the protruded portion.

The fluid container of this aspect has the linkage member and the joint part formed as separate components. This enhances the flexibility of design.

(6) In the fluid container of the above aspect, the linkage member may have a member positioning element configured to determine positions of the fluid supply structure and the container-side electrical connection structure relative to each other.

The fluid container of this aspect easily determines the positions of the fluid supply structure and the container-side electrical connection structure relative to each other. This accordingly ensures connection of the fluid supply structure with the fluid consuming device and contact of the contact element with the device-side electrical connection structure with high accuracy.

(7) In the fluid container of the above aspect, the fluid supply structure may have a flow assembly including a center axis extended in a predetermined direction. The member positioning element may have an outer shape surrounding a direction along the center axis.

The fluid container of this aspect suppresses the positional misalignment between the fluid supply structure and the container-side electrical connection structure in the direction perpendicular to the center axis.

(8) In the fluid container of the above aspect, the linkage member may have a plurality of the engagement elements.

The fluid container of this aspect causes a load produced by the own weight of the fluid container body when the user holds the handle part to be distributed to the plurality of engagement elements. This accordingly reduces the likelihood that the joint part is damaged.

(9) In the fluid container of the above aspect, the plurality of engagement elements may be arranged at positions across the fluid supply structure in a longitudinal direction of the joint part.

In the fluid container of this aspect, the load produced by the own weight of the fluid container is applied to parts of the engagement elements placed across the fluid supply structure. This reduces the likelihood that one side in the longitudinal direction of the joint part is significantly inclined relative to the fluid supply structure compared with the other side in the process of connecting the fluid container with the fluid consuming device. This accordingly enables the fluid supply structure to be connected (attached) to the fluid consuming device with high accuracy.

(10) In the fluid container of the above aspect, the plurality of engagement elements may be arranged at positions across the contact element in a longitudinal direction of the joint part.

In the fluid container of this aspect, the load produced by the own weight of the fluid container is applied to parts of the engagement elements placed across the contact element. This reduces the likelihood that one side in the longitudinal direction of the joint part is significantly inclined relative to the contact element compared with the other side in the process of connecting the fluid container with the fluid consuming device. This accordingly enables the contact element to come into contact with the fluid consuming device (more specifically, the device-side electrical connection structure) with high accuracy.

(11) In the fluid container of the above aspect, a width of the handle part along a longitudinal direction at the one end portion of the fluid container body may be smaller than a width of the joint part along the longitudinal direction at the one end portion of the fluid container. The fluid supply structure and the container-side electrical connection structure may be located between two ends of the handle part in the longitudinal direction at the one end portion of the fluid container body.

The fluid container of this aspect causes the fluid supply structure and the container-side electrical connection structure to be securely supported when the user holds the handle part.

(12) According to another aspect of the invention, there is provided a fluid container detachably connectable with a fluid consuming device. This fluid container comprises a fluid container body configured to contain a fluid; a fluid supply structure configured to make a flow of the fluid contained in the fluid container body to the fluid consuming device; and a handle member connected with the fluid supply structure and configured to be grasped. The handle member and the fluid supply structure are formed as separate components.

The fluid container of this aspect has the handle member and the fluid supply structure provided as separate components. Even when there is a necessity to change the material of the fluid supply structure associated with a change in type of the fluid contained in the fluid container body, there is no necessity to change the material of the handle member. When there is a certain change with regard to some component of the fluid container, this reduces the number of other components to be changed associated with this certain change.

(13) In the fluid container of the above aspect, at least part of the fluid supply structure which is in contact with the fluid may be made of a material including resistance to the fluid.

The fluid container of this aspect reduces the likelihood that the fluid supply structure is deteriorated (damaged) by the fluid.

(14) In the fluid container of the above aspect, at least part of the handle member which the fluid supply structure is directly connected with may be made of a material having excellent deformation resistance or creep resistance.

The fluid supply structure is an important part that is to be connected with the fluid consuming device. In the fluid container of this aspect, the directly connected part (supply assembly connection part) is made of the material having excellent deformation resistance or creep resistance. This suppresses deformation of the supply assembly connection part. This accordingly suppresses the positional misalignment of the fluid supply structure due to deformation of the supply assembly connection part and enables the fluid supply structure to be accurately and securely connected with the fluid consuming device.

(15) The fluid container of the above aspect may further comprise a pushing part located on an opposite side to the fluid supply structure across the handle member and configured to be push when the fluid container is connected with the fluid consuming device.

The fluid container of this aspect enables the user to readily connect the fluid supply structure with the fluid consuming device by simply pressing the pushing part.

(16) In the fluid container of the above aspect, the handle member and the pushing part may be formed as separate components.

The fluid container of this aspect has the handle member and the pushing part provided as separate components. This enables the shape and the area of the pushing part to be freely determined, irrespective of the shape and the size of the handle member. This may accordingly locate part of the pushing part at an overlapping position with the fluid container body. Locating part of the pushing part at the overlapping position with the fluid container body allows for the effective use of the limited space and ensures a predetermined or greater volume of the fluid container body while increasing the outer shape of the pushing part.

(17) In the fluid container of the above aspect, the pushing part may have an appearance for identification of color of the fluid contained in the fluid container body.

The fluid container of this aspect enables the user to readily identify the color of the fluid contained in the fluid container body by visually recognizing the pushing part.

(18) In the fluid container of the above aspect, the pushing part may have an identification area colored in the color of the fluid contained in the fluid container body.

The fluid container of this aspect enables the user to readily identify the color of the fluid contained in the fluid container body by visually recognizing the colored area. When there is a change in color of the fluid contained in the fluid container body, there is a necessity to change only the color of the identification area.

(19) In the fluid container of the above aspect, the pushing part may have a colored area colored in an identical color with color of a connection member of the fluid consuming device used for connection of the fluid container.

The fluid container of this aspect enables the user to readily identify the connection member corresponding to the fluid container by visually recognizing the colored area. This reduces the likelihood that a wrong fluid container containing a different color of fluid, which is not to be mounted, is mistakenly connected with the fluid consuming device.

(20) In the fluid container of the above aspect, the handle member may include a plurality of support portions configured to receive a load produced by the fluid container body.

The fluid container of this aspect causes a load applied to the handle member to be dispersed to the plurality of support portions and thereby suppresses deformation of the handle member. This configuration accordingly suppresses the positional misalignment of the fluid supply structure and ensures the accurate and secure connection of the fluid supply structure with the fluid consuming device.

All the plurality of components included in the aspects of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described above to provide still another independent aspect of the invention.

For example, one aspect of the invention may be implemented as a device including one or more components among a plurality of components, i.e., a fluid container body, a fluid supply structure, a container-side electrical connection structure and a linkage member. In other words, this device may have or may not have the fluid container body. This device may have or may not have the fluid supply structure. This device may have or may not have the container-side electrical connection structure. This device may have or may not have the linkage member.

For example, another aspect of the invention may be implemented as a device including one or more components among a plurality of components, i.e., a fluid container body, a fluid supply structure and a handle member. In other words, this device may have or may not have the fluid container body. This device may have or may not have the fluid supply structure. This device may have or may not have the handle member.

The respective aspects described above solve at least one of the various problems described above, for example, downsizing of the device, cost reduction, resource saving, easy manufacture and improvement of usability. Part or all of the technical features in each of the aspects of the fluid container described above may be applied to the device of the above aspect.

The invention may be implemented by any of various aspects other than the fluid container, for example, a manufacturing method of the fluid container and a fluid consuming system including the fluid container and a fluid consuming device.

DESCRIPTION OF EMBODIMENTS

A. Embodiment

A-1. Configuration of Fluid Consuming System

Figure 1:
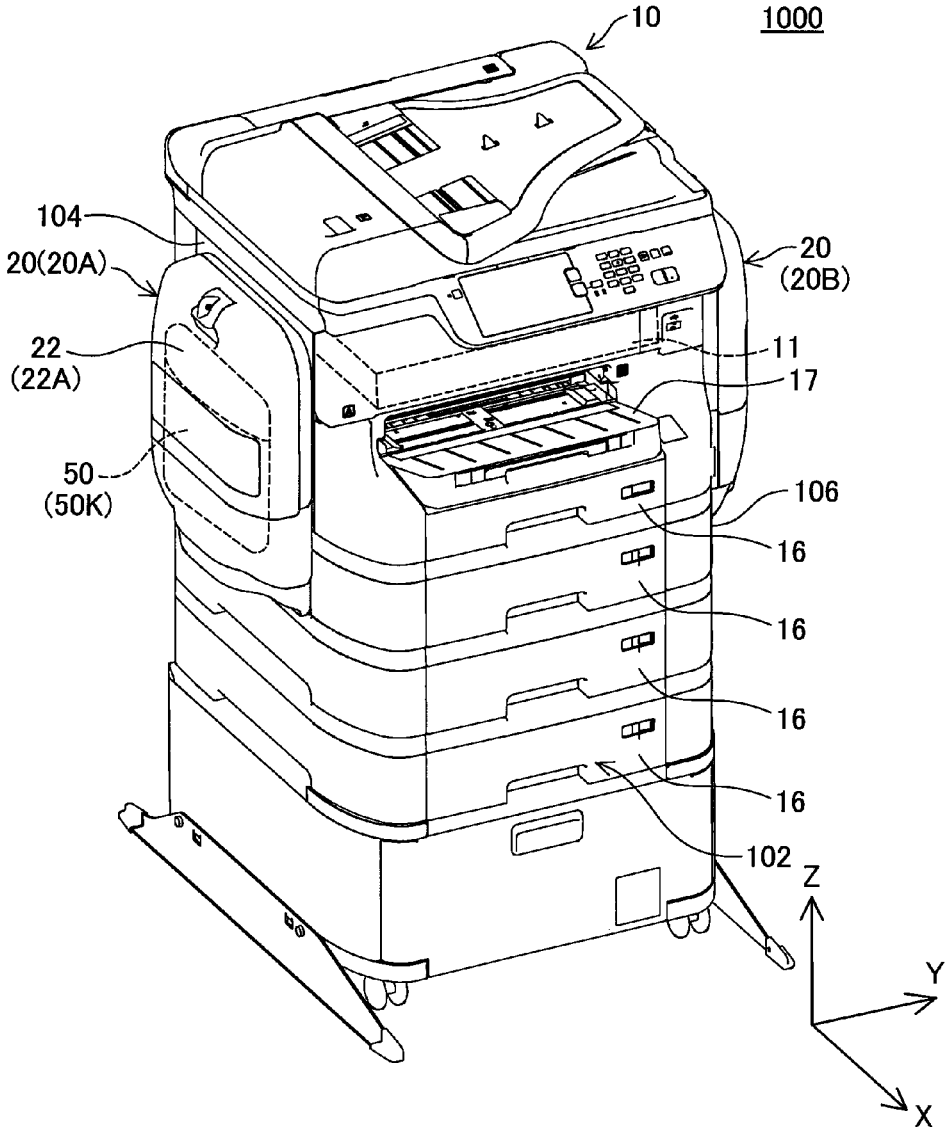
FIG. 1 is a first perspective view illustrating the general configuration of a fluid consuming system.
Figure 2:
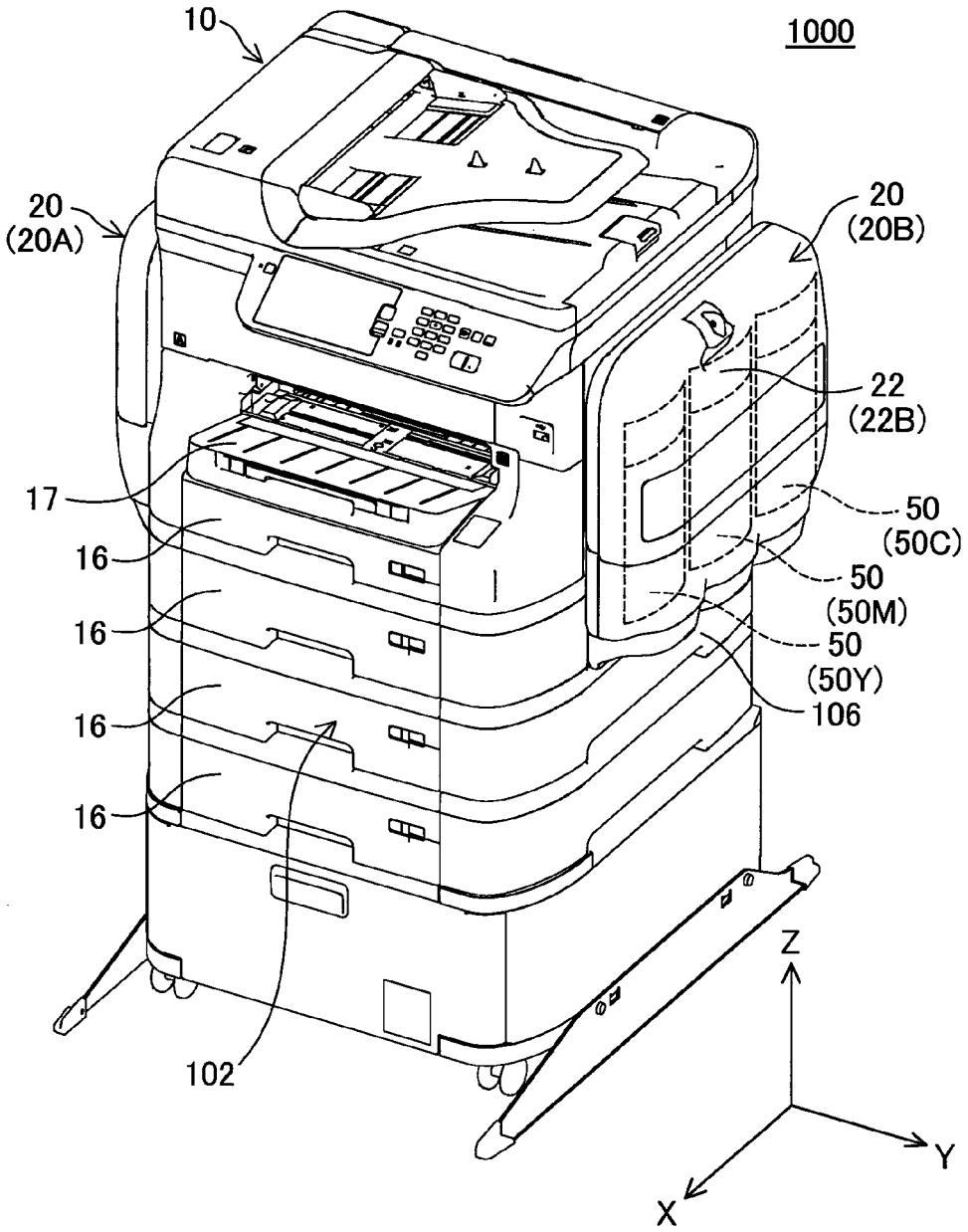
FIG. 2 is a second perspective view illustrating the general configuration of the fluid consuming system.
Figure 3:
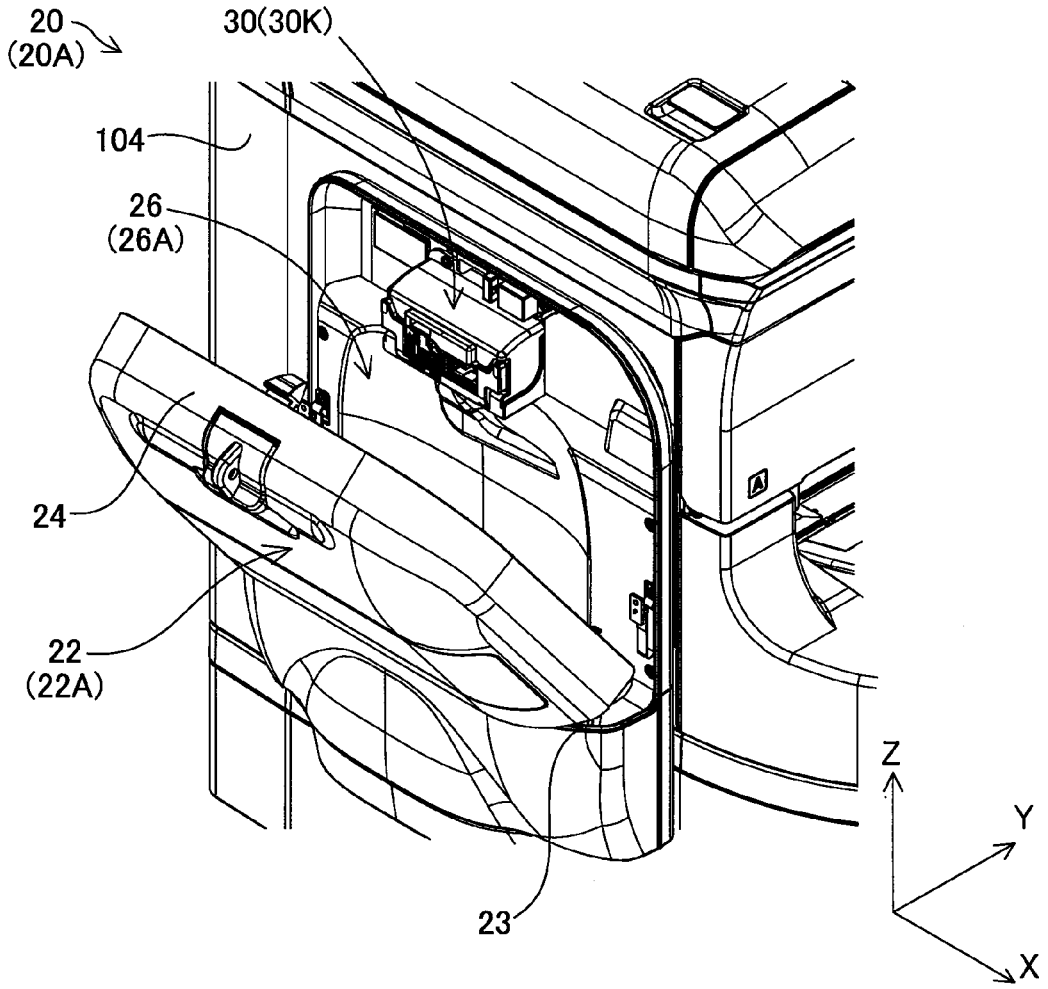
FIG. 3 is a first diagram illustrating a fluid supply device.
Figure 4:
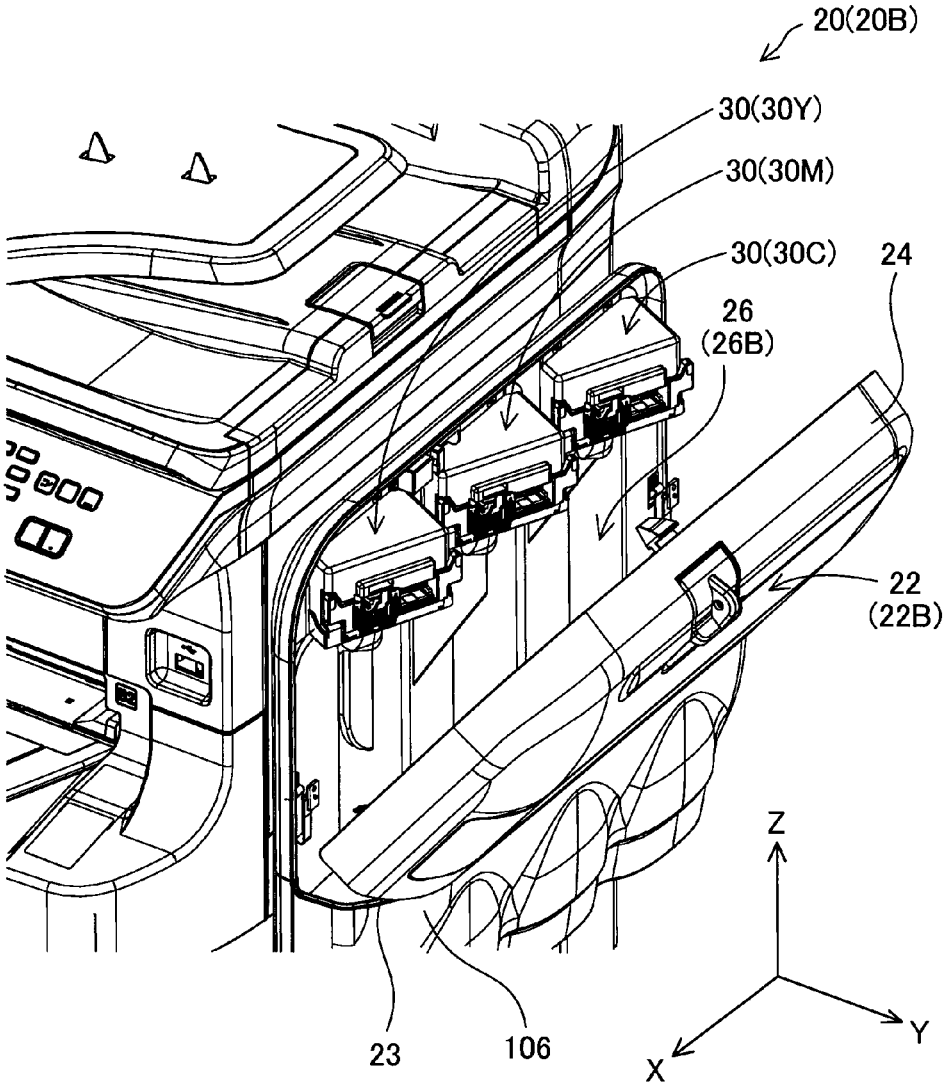
FIG. 4 is a second diagram illustrating the fluid supply device.

FIG. 1 is a first perspective view illustrating the general configuration of a fluid consuming system 1000. FIG. 2 is a second perspective view illustrating the general configuration of the fluid consuming system 1000. FIG. 3 is a first diagram illustrating a fluid supply device 20. FIG. 4 is a second diagram illustrating the fluid supply device 20. FIGS. 3 and 4 illustrate the state that fluid containers described later are demounted. X-axis, Y-axis and Z-axis orthogonal to one another are shown in FIGS. 1 to 4.

As shown in FIG. 1, the fluid consuming system 1000 includes a printer 10 as a fluid consuming device and two fluid supply devices 20. In the use state of the fluid consuming system 1000, the printer 10 is placed on a horizontal plane defined by an X-axis direction and a Y-axis direction. In other words, a Z-axis direction is a vertical direction (top-bottom direction); −Z-axis direction is vertically downward and +Z-axis direction is vertically upward. The fluid supply devices 20 are configured to supply inks as fluids to the printer 10. Each fluid container (fluid containing bag unit) 50 included in the fluid supply device 20 is detachably connected (attached) to the printer 10.

The printer 10 is an inkjet printer. The printer 10 includes a recording mechanism 11, feed trays 16 and an eject tray 17. A plurality of the feed trays 16 are provided at different height positions in the vertical direction. The feed trays 16 are placed on a device first surface (device front surface) 102 of the printer 10. The feed trays 16 contain recording media (for example, paper sheets) on which images such as characters and letters are printed (recorded) by the printer 10.

The recording mechanism 11 includes a record head (not shown) configured to eject ink. The record head is connected with the fluid supply devices 20 through flow pipes such as tubes. The record head ejects ink supplied from the fluid supply device 20 on the recording medium to perform recording (printing). The recording medium after recording is discharged to the eject tray 17.

The two fluid supply devices 20 are respectively placed on a device second surface (also called device first side surface or device first side wall) 104 and a device third surface (also called device second side surface or device second side wall) 106 arranged to intersect with the device first surface (also called device front surface or device front wall) 102 of the printer 10. The device first surface 102 to the device third surface 106 are surfaces respectively perpendicular to the installation surface of the printer 10 in the use state of the printer 10. The device second surface 104 and the device third surface 106 are opposed to each other. In the description hereof, the fluid supply device 20 provided on the device second surface 104 is also called first fluid supply device 20A, and the fluid supply device 20 provided on the device third surface 106 is also called second fluid supply device 20B. When there is no necessity to distinguish between the first and the second fluid supply devices 20A and 20B, the first and the second fluid supply devices 20A and 20B are simply called fluid supply devices 20.

As shown in FIG. 1, the first fluid supply device 20A includes one cover member 22, one fluid container (fluid-containing bag unit) 50 and one mounting assembly unit 30 (shown in FIG. 3). As shown in FIG. 2, the second fluid supply device 20B includes one cover member 22, three fluid containers 50 and three mounting assembly units 30 provided corresponding to the respective fluid containers 50 (shown in FIG. 4). The two cover members 22 are distinguishable from each other by using symbols "22A" and "22B". The four fluid containers 50 are distinguishable from one another by using symbols "50K", "50C", "50M" and "50Y". The four mounting assembly units 30 are distinguishable from one another by using symbols "30K", "30C", "30M" and "30Y". The numbers of the cover members 22, the fluid containers 50 and the mounting assembly units 30 are not limited to this example. For example, the number of the fluid containers 50 may be three or less or may be five or more. The number of the mounting assembly units 30 may be determined corresponding to the number of the fluid containers 50. The number of the cover members 22 may be one or may be three or more.

The four fluid containers 50 contain (are filled with) different types of inks. According to this embodiment, yellow (Y), magenta (M), cyan (C) and black (K) inks are contained in the respective different fluid containers 50. The fluid container 50K has a fluid container body configured to contain black ink. The fluid container 50C has a fluid container body configured to contain cyan ink. The fluid container 50M has a fluid container body configured to contain magenta ink. The fluid container 50Y has a fluid container body configured to contain yellow ink. As shown in FIGS. 3 and 4, the fluid container 50 is contained in a housing space 26 defined by the cover member 22. More specifically, the fluid container 50K is contained in a housing space 26A (shown in FIG. 3), and the fluid containers 50C, 50M and 50Y are contained in a housing space 26B (shown in FIG. 4).

The mounting assembly units 30 shown in FIGS. 3 and 4 serve to mount the fluid containers 50 in a detachable manner. The mounting assembly unit 30K is placed inside of the cover member 22A, and the mounting assembly units 30C, 30M and 30Y are placed inside of the cover member 22B. As shown in FIG. 3, the mounting assembly unit 30K is provided on the device second surface 104 of the printer 10. As shown in FIG. 4, the mounting assembly units 30C, 30M and 30Y are provided on the device third surface 106 of the printer 10. In the state that the fluid container 50 is mounted to the mounting assembly unit 30, the ink contained in the fluid container 50 is supplied to the record head of the printer 10 by a supply mechanism (not shown) with a pump function included in the printer 10.

As shown in FIGS. 3 and 4, the cover member 22 is arranged to be openable and closable by rotating the other end 24 on the upper side in the vertical direction about one end portion 23 on the lower side in the vertical direction as the support point. After consumption of the ink contained in the fluid container 50, the user opens the cover member 22 and demounts the exhausted fluid container 50 from the mounting assembly unit 30. The user then mounts a new fluid container 50 to the mounting assembly unit 30 and closes the cover member 22.

A-2. Structure of Mounting Assembly Unit 30

Figure 5:
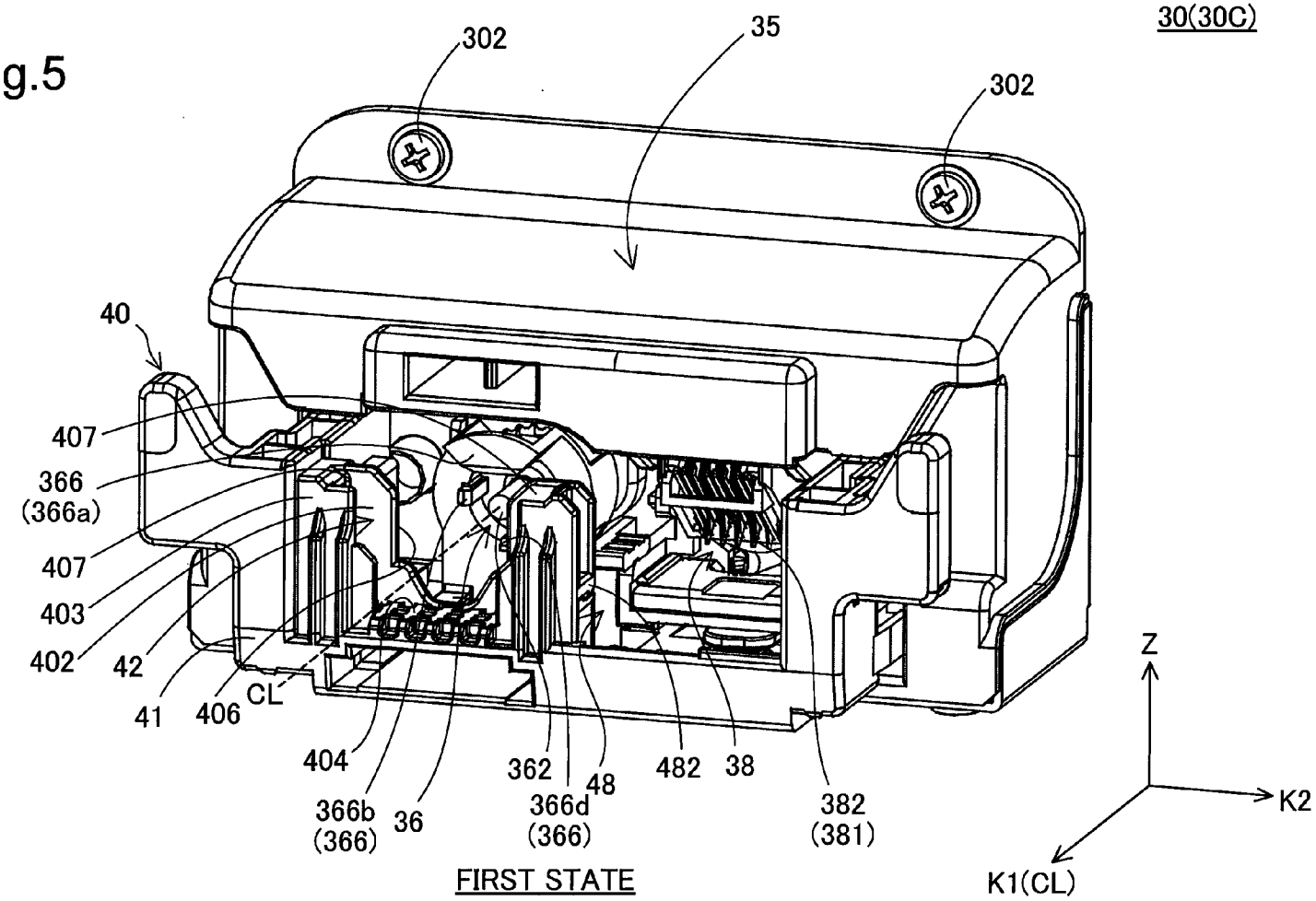
FIG. 5 is a first perspective view illustrating a mounting assembly unit.
Figure 6:
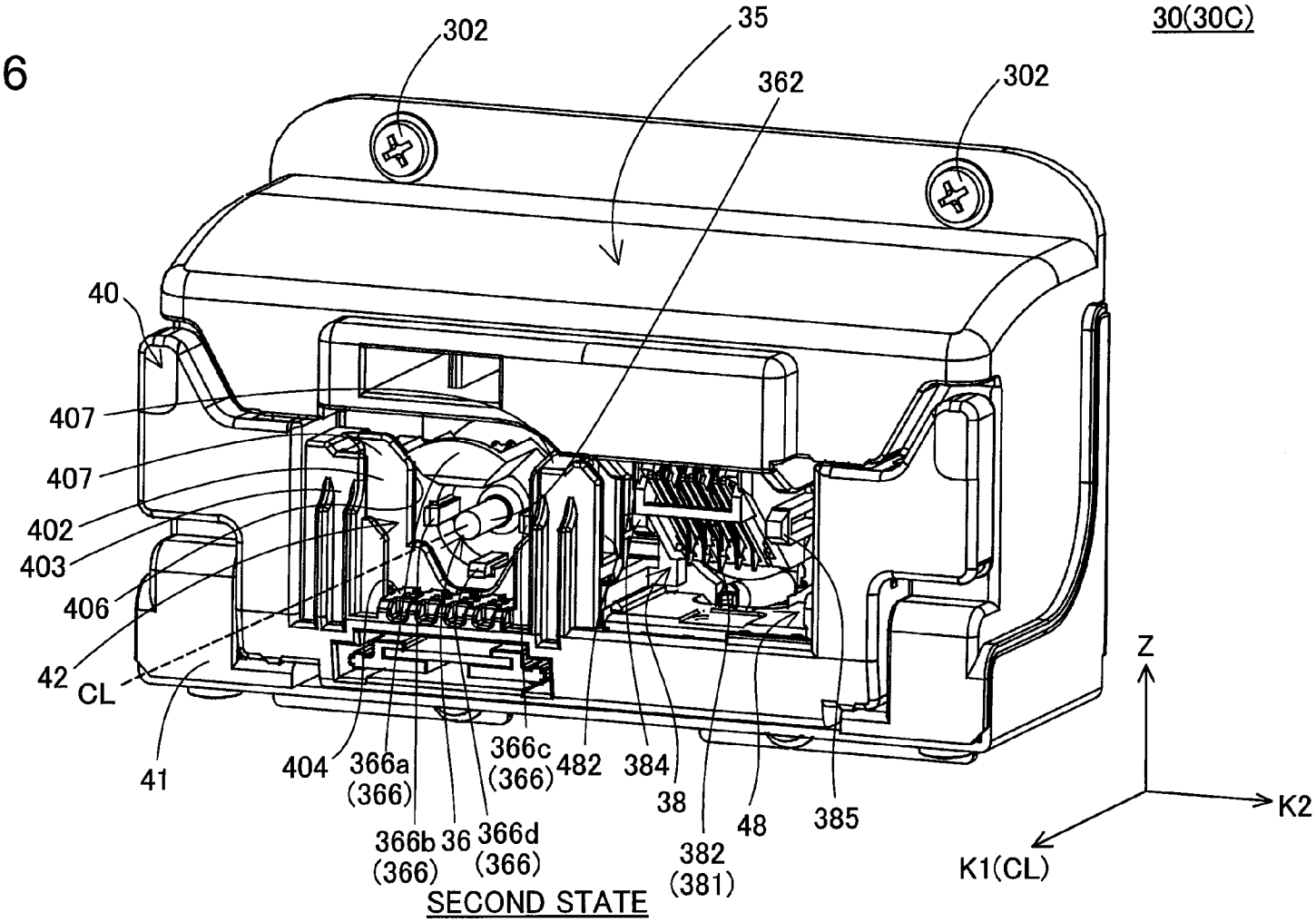
FIG. 6 is a second perspective view illustrating the mounting assembly unit.

FIG. 5 is a first perspective view illustrating the mounting assembly unit 30. FIG. 6 is a second perspective view illustrating the mounting assembly unit 30. FIG. 5 illustrates a first state (setting state) in which a movable member 40 is protruded outward relative to a stationary member 35. FIG. 6 illustrates a second state (mounting state) in which the movable member 40 is placed in the stationary member 35. The following describes the structure of the mounting assembly unit 30C as an example with reference to FIGS. 5 and 6. The other mounting assembly units 30K, 30M and 30Y have the same structures as that of the mounting assembly unit 30C. As shown in FIG. 5, the mounting assembly unit 30 includes a stationary member 35 and a movable member 40.

The fluid container 50 is mounted to the mounting assembly unit 30 by the following two operations. The state that the fluid container 50 is mounted to the mounting assembly unit 30 is also called "mounting state (connecting state)". The "mounting state (connecting state)" denotes the state that a fluid supply structure (fluid flow assembly) 57 of the fluid container 50 described later is connected with a fluid introducing structure (fluid introducing needle) 362 of the mounting assembly unit 30 and that a circuit board 582 of the fluid container 50 is electrically connected with an electrical connection structure (device-side electrical connection structure) 382 of the mounting assembly unit 30. In the mounting state, the ink contained in the fluid container 50 can be flowed to the printer 10.

First Operation:

The user makes the mounting assembly unit 30 in the first state and sets the fluid container 50 in the movable member 40.

Second Operation:

After the first operation, the user pushes the movable member 40 toward the stationary member 35-side via the fluid container 50 to make the mounting assembly unit 30 in the second state.

In the second state of the mounting assembly unit 30, the motion of the movable member 40 relative to the stationary member 35 in a +K1-axis direction is restricted by a lock mechanism. In the second state, the lock mechanism is unlocked by pressing the movable member 40 inward (−K1-axis direction) relative to the stationary member 35. The movable member 40 may subsequently be moved to be protruded outward (in the +Z-axis direction) relative to the stationary member 35, so that the state of the mounting assembly unit 30 may be changed from the second state to the first state.

The stationary member 35 is fixed to the surface 104 or 106 of the printer 10 by means of a plurality of screws 302 serving as fixation elements. More specifically, the mounting assembly unit 30K (shown in FIG. 3) is fixed to the second surface 104 by means of a plurality of screws 302, and the mounting assembly units 30C, 30M and 30K (shown in FIG. 4) are fixed to the third surface 106 by means of a plurality of screws 302.

The stationary member 35 has a fluid introducing mechanism 36 and a contact mechanism 38. The fluid introducing mechanism 36 includes a fluid introducing structure 362. The fluid introducing structure 362 is connected with a fluid supply structure included in the fluid container 50 as described later, so as to make a flow of the ink contained in the fluid container 50. The fluid introducing structure 362 is arranged to communicate with the record head of the printer 10.

The fluid introducing structure 362 is formed in a needle-like shape to have an inner cavity for an ink flow. The fluid introducing structure 362 is extended along a center axis CL. The direction along the center axis CL (direction in which the fluid introducing structure 362 is extended) is K1-axis direction. The K1-axis direction is orthogonal to Z-axis direction. The direction orthogonal to both the K1-axis direction and the Z-axis direction is K2-axis direction. The plane defined by the K1-axis direction and the K2-axis direction is parallel to the plane defined by the X-axis direction and the Y-axis direction shown in FIG. 1. With respect to the K1-axis direction, the outward direction of the printer 10 is the +K1-axis direction, and the inward direction of the printer 10 is the −K1-axis direction.

The fluid introducing mechanism 36 and the contact mechanism 38 are aligned in the K2-axis direction. With respect to the K2-axis direction, the direction from the fluid introducing mechanism 36 toward the contact mechanism 38 is the +K2-axis direction, and the direction from the contact mechanism 38 toward the fluid introducing mechanism 36 is the −K2-axis direction. With respect to the mounting assembly unit 30, the Z-axis direction is also called "height direction", the K1-axis direction is also called "width direction", and the K2-axis direction is also called "depth direction".

As shown in FIGS. 5 and 6, the contact mechanism 38 includes the electrical connection structure 382 with a plurality of (nine in this embodiment) device-side terminals 381 and a plurality of (two in this embodiment) device-side substrate positioning structures 384 and 385. In the mounting state of the fluid container 50, the device-side terminals 381 of the electrical connection structure 382 are in contact with (are electrically connected with) a circuit board of the fluid container 50. This allows for communication of various information (for example, the color of ink contained in the fluid container 50 and the date of manufacture of the fluid container 50) between the circuit board of the fluid container 50 and the printer 10. The device-side terminals 381 are made of elastically deformable metal flat springs. The device-side substrate positioning structures 384 and 385 are arranged on respective sides across the electrical connection structure 382 in the K2-axis direction (direction in which the fluid introducing mechanism 36 and the contact mechanism 38 are aligned). The device-side substrate positioning structures 384 and 385 serve to eventually position the circuit board of the fluid container 50 relative to the electrical connection structure 382 when the fluid container 50 is mounted to the mounting assembly unit 30. The device-side substrate positioning structures 384 and 385 are members extended along the K1-axis direction.

The movable member 40 is configured to be movable along the K1-axis direction relative to the stationary member 35. The movable member 40 includes a base section 41, a supply structure support portion 42 and a substrate support portion 48. The supply structure support portion 42 and the substrate support portion 48 are respectively connected with the base section 41. The supply structure support portion 42 and the substrate support portion 48 are respectively members extended from the base section 41 in the +Z-axis direction (upward).

The supply structure support portion 42 is a member serving to determine the position of the fluid container 50 (more specifically, its fluid supply structure) relative to the fluid introducing structure 362. When the mounting assembly unit 30 is viewed along the K1-axis direction, the supply structure support portion 42 is located at a position overlapping with the fluid introducing structure 362. The supply structure support portion 42 is formed in a concave shape in the −Z-axis direction. The supply structure support portion 42 has grooves 407 formed on both sides thereof in the K2-axis direction. Entering a positioning structure (described later) of the fluid container 50 into the grooves 407 restricts the motion of the fluid supply structure of the fluid container 50 and roughly position the fluid container 50 relative to the mounting assembly unit 30. More specifically, a plurality of planes defining the supply structure support portion 42 (for example, a first support plane 402, second support planes 403 and a third support plane 404) restrict the motion of the fluid supply structure of the fluid container 50. The first support plane 402 of the supply structure support portion 42 located on the fluid introducing structure 362-side has a cut 406. The cut 406 is formed in a concave shape open on the +Z-axis direction side. When the mounting assembly unit 30 is viewed along the K1-axis direction, the cut 406 is located at a position overlapping with the fluid introducing structure 362. In the first state that the movable member 40 is moved to the most +K1-axis direction side relative to the stationary member 35, the cut 406 is located on the +K1-axis direction side of the fluid introducing structure 362. As shown in FIG. 6, in the second state, an end of the fluid introducing structure 362 is located inside of the cut 406.

The substrate support portion 48 is a member serving to determine the position of the fluid container 50 (more specifically, the circuit board) relative to the contact mechanism 38. When the mounting assembly unit 30 is viewed along the K1-axis direction, the substrate support portion 48 is located at a position overlapping with the contact mechanism 38. The substrate support portion 48 is formed in a concave shape in the −Z-axis direction. A plurality of planes defining the substrate support portion 48 (for example, a first substrate support plane 482) restrict the motion of the circuit board of the fluid container 50.

As described above, the movable member 40 is used to connect the fluid container 50 with the printer 10. The movable member 40 is thus also referred to as "connection member 40". The connection member 40 is colored in the color of ink contained in the corresponding fluid container 50K, 50C, 50M or 50Y to be connected with the mounting assembly unit 30 among the plurality of fluid containers 50K, 50C, 50M and 50Y respectively containing different color inks. For example, the connection member 40 included in the mounting assembly unit 30Y to be connected with the fluid container 50Y containing yellow ink is colored in yellow. Herein "being colored in the color of ink" includes being colored in the same type of color as the color of ink. The "same type of color" may be a similar color in such a range that allows the user to identify the fluid container 50 to be connected by visually recognizing the connection member 40. The "same type of color" means, for example, colors including hue difference of 0 to 3 in the 20-color hue wheel (modified Munsell color wheel) employed in JIS standard (JIS Z 8102).

A-3. Structure of Fluid Container 50

Figure 7:
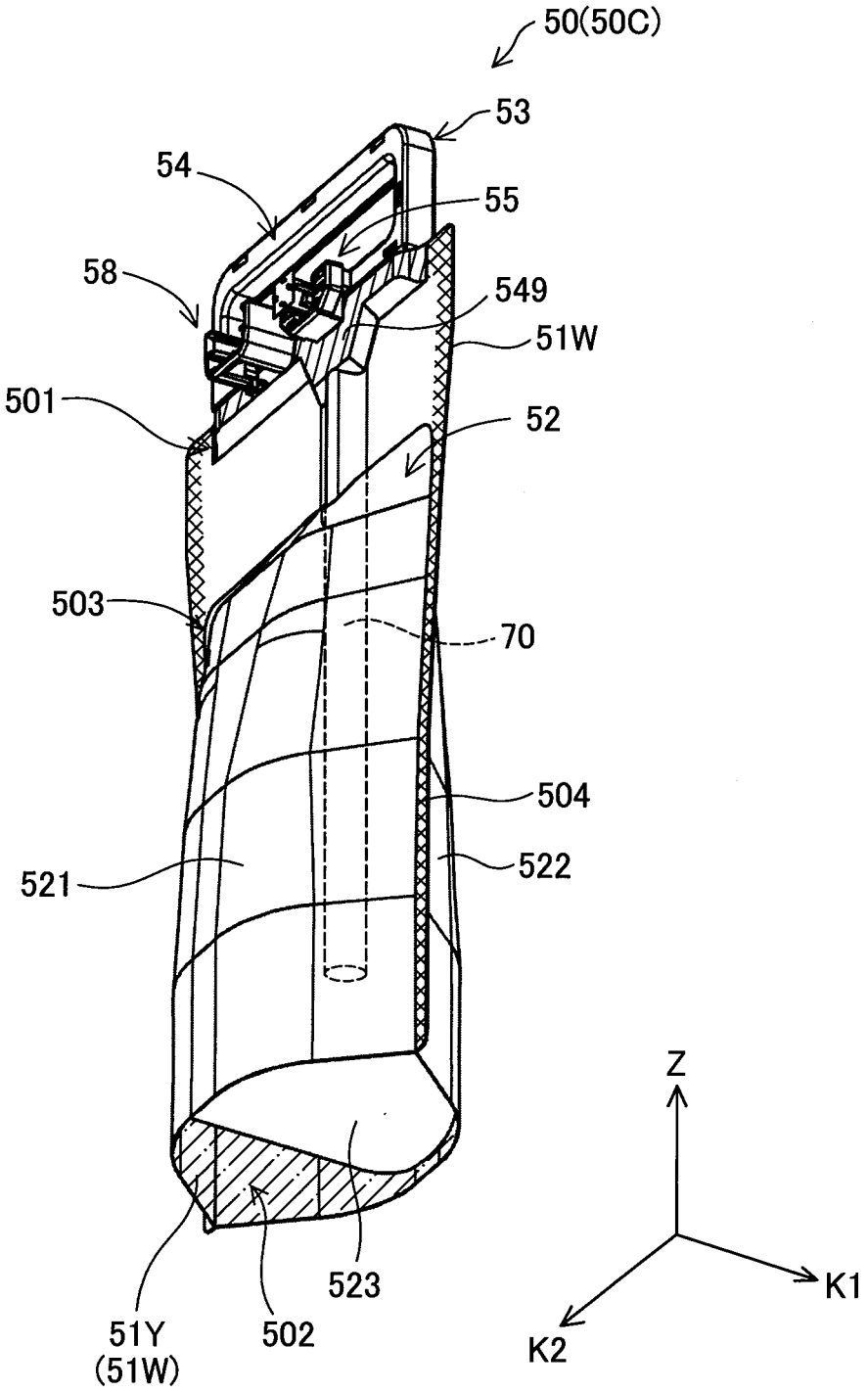
FIG. 7 is a first perspective view illustrating a fluid container.
Figure 8:
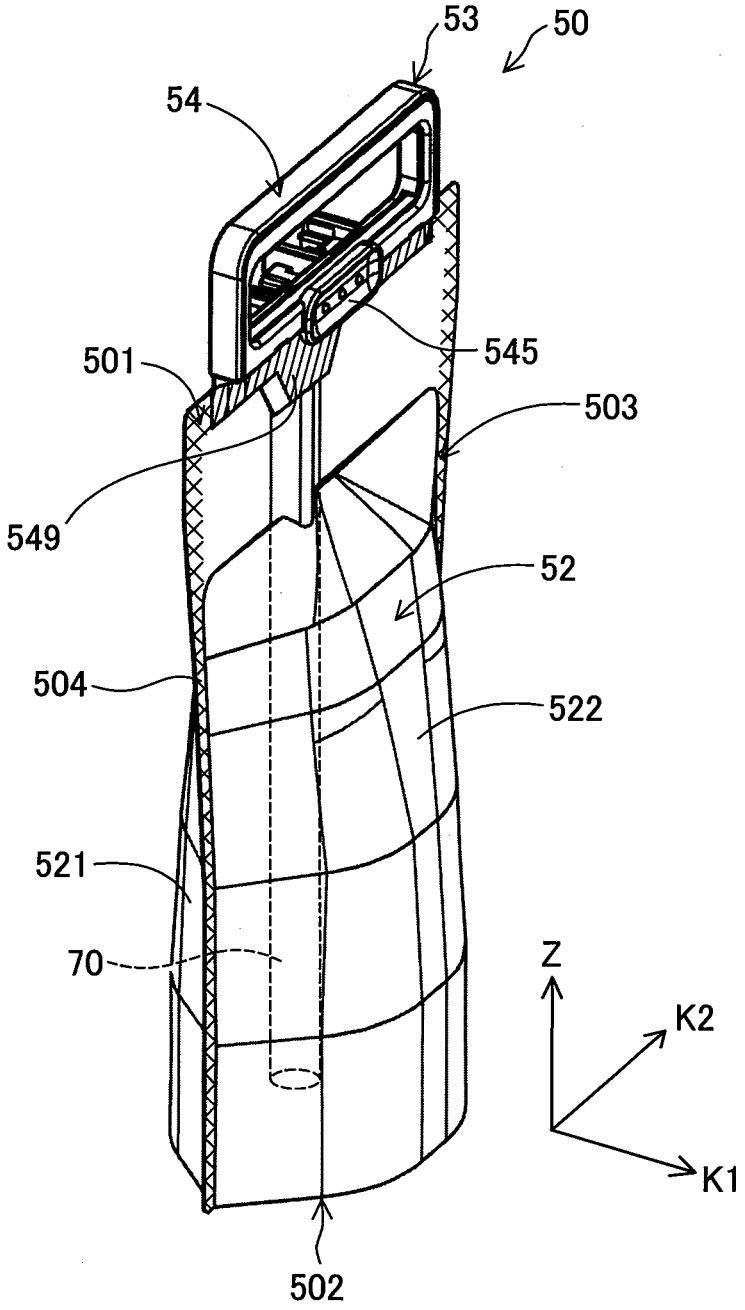
FIG. 8 is a second perspective view illustrating the fluid container.
Figure 8A:
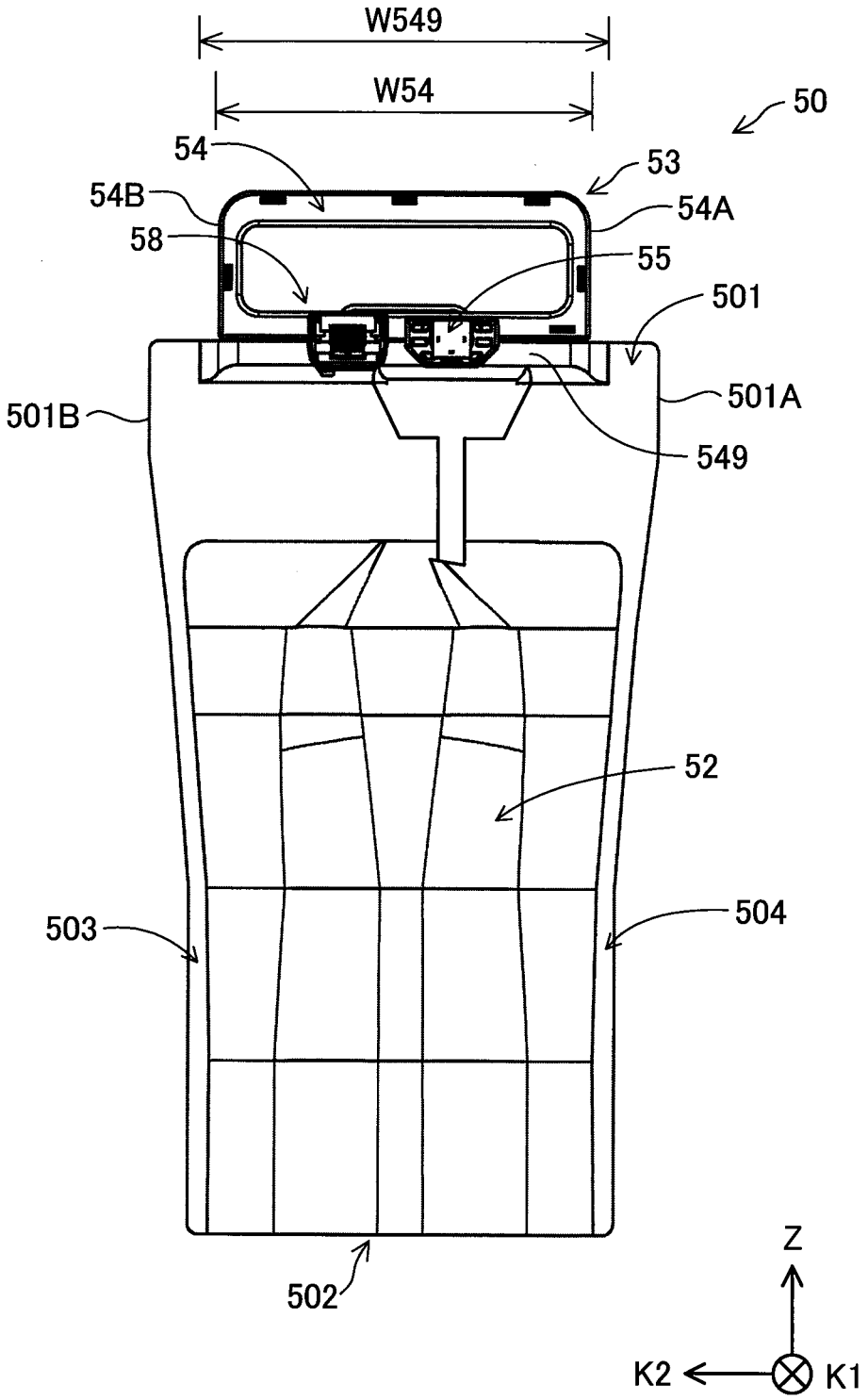
FIG. 8A is a front view illustrating the fluid container.
Figure 8B:
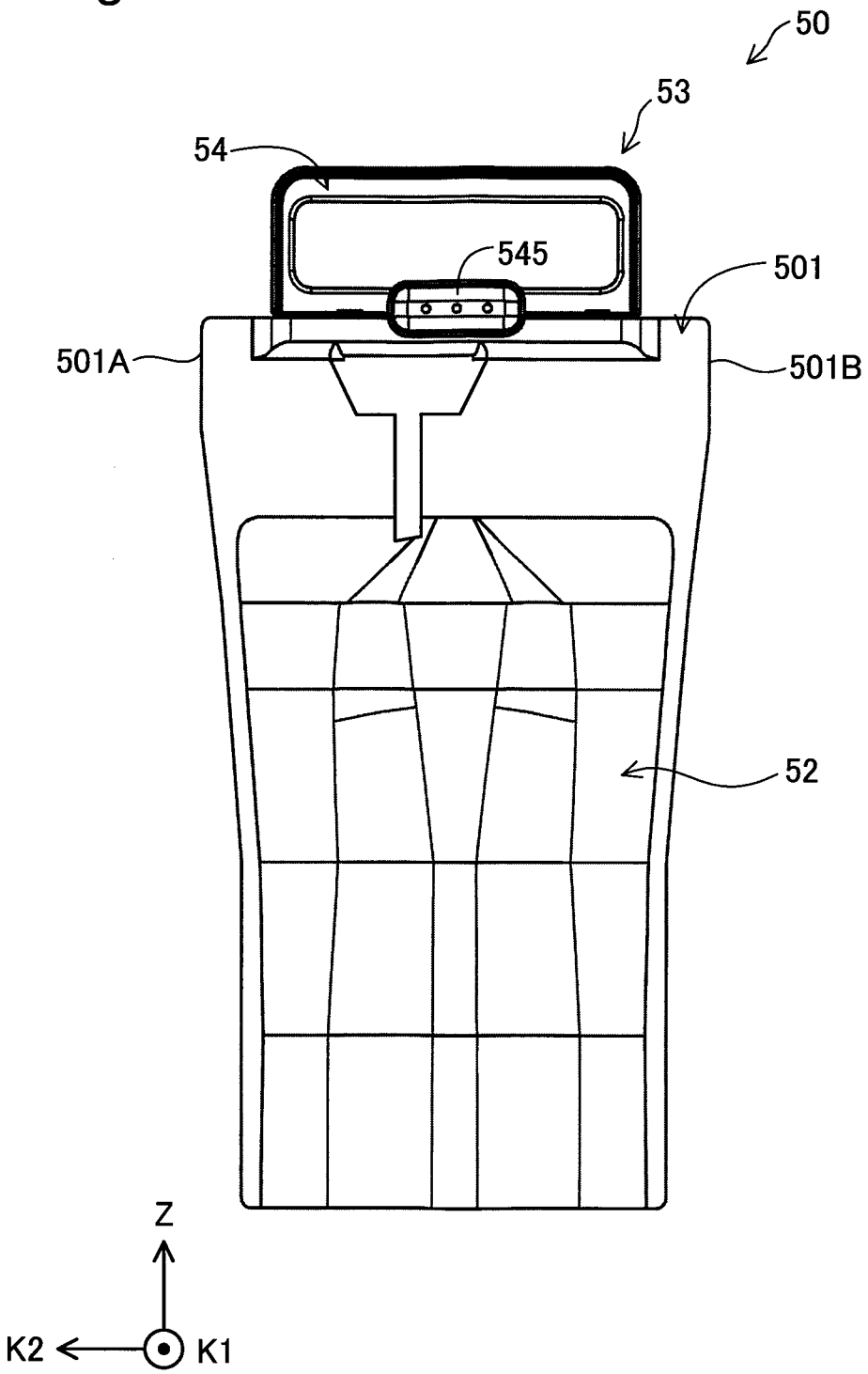
FIG. 8B is a rear view illustrating the fluid container.

FIG. 7 is a first perspective view illustrating the fluid container 50. FIG. 8 is a second perspective view illustrating the fluid container 50. FIG. 8A is a front view illustrating the fluid container 50. FIG. 8B is a rear view illustrating the fluid container 50. The Z-axis, the K1-axis and the K2-axis in the state that the fluid container 50 is mounted to the mounting assembly unit 30 (in the mounting state) are shown in FIGS. 7, 8, 8A and 8B. FIGS. 7 and 8 illustrate the fluid container 50 in the state of being filled with ink as a fluid before the fluid container 50 is mounted to the mounting assembly unit 30 (i.e., unused state). The Z-axis, the K1-axis and the K2-axis orthogonal to one another are also shown as appropriate in the subsequent drawings referred to for description of the fluid container 50. The following describes the structure of the fluid container 50C as an example with reference to FIG. 7 and subsequent diagrams. The other fluid containers 50K, 50M and 50Y have the same structures as that of the fluid container 50C.

As shown in FIG. 7, the fluid container 50 includes a fluid container body (fluid containing bag) 52 and an operation member (linkage member, handle member) 53. The operation member 53 is attached to the fluid container body 52. The operation member 53 has a grip section (holding section) 54, a fluid supply unit 55, a substrate unit (container-side electrical connection structure) 58 and a pushing part 545 (shown in FIG. 8). The grip section 54 is a part grasped by the user to hold the fluid container 50. The grip section 54 may thus also be called "handle part 54" or "handle part". The fluid supply unit 55 is a part corresponding to the fluid introducing structure 362 and the supply structure support portion 42 (shown in FIG. 6) of the mounting assembly unit 30. The substrate unit 58 is a part corresponding to the electrical connection structure 382 and the substrate support portion 48 (shown in FIG. 6) of the mounting assembly unit 30. The grip section 54 of the operation member 53 is formed in an approximately rectangular frame-like shape in this embodiment but may be formed in an approximate C shape or in an approximate T shape.

The fluid container body 52 is configured to contain ink as the fluid. The fluid container body 52 is attached to the operation member 53 in such a state that the bag surface (outer surface) is exposed. In other words, the fluid container body 52 is not placed in a casing but is made visible from outside. The fluid container body 52 has the volume decreasing with a decrease in amount of the ink contained.

The fluid container body 52 has a first film 521, a second film 522 and a third film 523. The first to the third films 521 to 523 are arranged to define an inner space for containing ink. A side of the fluid container body 52 which the operation member 53 is attached to is expressed as one end portion (one end portion, upper end) 501-side, and a side opposite to the one end portion 501 is expressed as the other end (the other end part, bottom end) 502-side. One end portion side (+K2-axis direction side) of the fluid container body 52 is expressed as first side end (first side end section) 503-side, and the other end side (−K2-axis direction side) is expressed as second side end (second side end section) 504-side. As shown in FIG. 8A, the fluid supply unit 55 (the fluid supply structure 57) and the substrate unit 58 are located on the one end portion 501-side of the fluid container body 52. In this embodiment, when the fluid container 50 is viewed along the K1-axis direction as shown in FIG. 8A, the fluid supply unit 55 and the substrate unit 58 are located to at least partly overlap with the one end portion 501.

As shown in FIGS. 7 and 8, in the mounting state of the fluid container 50, the first film 521 and the second film 522 constitute a side surface of the fluid container body 52. In the mounting state of the fluid container 50, the third film 523 constitutes a bottom surface of the fluid container body 52. The first film 521 and the second film 522 are arranged to face each other. The first film 521 and the second film 522 respectively have peripheral areas 51W partly welded. More specifically, a one end portion 501-side part, a first side end 503-side part and a second side end 504-side part of the peripheral areas 51W are welded. In order to facilitate understanding, the welded parts of the first film 521 and the second film 522 are shown by cross-hatching in FIGS. 7 and 8. The operation member 53 is welded to the one end portion 501 of the fluid container body 52 (more specifically, the one end portions of the first and the second films 521 and 522). In other words, the operation member 53 is a member mountable to the one end portion 501 of the fluid container body 52. In order to facilitate understanding, the welded part of the operation member 53 to the first and the second films 521 and 522 is shown by the solid line single-hatching in FIGS. 7 and 8. The first and the second film members 521 and 522 are attached to an attachment section (joint part) 549 of the operation member 53 by welding as described later in detail.

As shown in FIG. 7, a peripheral area 51Y of the third film 523 is welded to part of the peripheral areas 51W of the first and the second films 521 and 522. The welded part of the third film 523 to the first and the second films 521 and 522 is shown by the one-dot chain line single-hatching. As described above, the fluid container body 52 of the embodiment is in a form that the three films 521, 522 and 523 are bonded by, for example, welding (pouch-like form having a bottom surface).

The first to the third films 521 to 523 are members having flexibility. The material used for the first to the third films 521 to 523 may be, for example, polyethylene terephthalate (PET), nylon or polyethylene. The first to the third films 521 to 523 may have layered structure formed by stacking a plurality of films made of these materials. In the layered structure, for example, an outer layer may be made of PET or nylon having excellent impact resistance, and an inner layer may be made of polyethylene having excellent ink resistance. A film having a deposited layer of, for example, aluminum may be included as one component member of the layered structure. This enhances the gas barrier property and suppresses, for example, a change in concentration of the ink contained in the fluid container body 52. In this manner, the material of the fluid container body 52 may be determined arbitrarily.

The shape and the size of the fluid container body 52 may be determined arbitrarily. For example, the fluid container body 52K containing black ink may be made to have the larger capacity (larger size) than that of the fluid container body 52C containing another color ink (for example, cyan ink). According to this embodiment, the fluid container body 52 is in the form that the first to the third films 521 to 523 are bonded by, for example, welding. The fluid container body 52 may alternatively be in a form that the first and the second films 521 and 522 are bonded by, for example, welding with omission of the third film 523 (pillow-like form). As described above, the fluid container body 52 and the operation member 53 are separate components. Accordingly, the type of the fluid container body 52 (shape, size and material) may be readily changed, while the same operation member 53 is employed. In other words, the shape, the size and the material of the fluid container body 52 may be determined according to the properties and the volume of the fluid to be contained in the fluid container body 52. This increases the flexibility of design.

The fluid container 50 additionally has a flow path member 70 to make a flow of the ink contained in the fluid container body 52 to the fluid supply unit 55 (more specifically, its fluid supply structure). According to this embodiment, the flow path member 70 is a tube. The flow path member 70 is placed inside of the fluid container body 52.

The respective components of the fluid container 50 have the relationship described below with reference to FIG. 8A. The grip section 54 has a width W54 along the longitudinal direction (K2-axis direction) of the one end portion 501 of the fluid container body 52. The joint part 549 has a width W549 along the longitudinal direction (K2-axis direction) of the joint part 549. The width W54 denotes the distance between one end portion 54A and the other end 54B of the grip section 54 in the longitudinal direction (K2-axis direction). The width W54 is smaller than the width W549. The fluid supply unit 55 and the substrate unit 58 are located between the respective ends 54A and 54B of the grip section 54 in the longitudinal direction (K2-axis direction).

Figure 9:
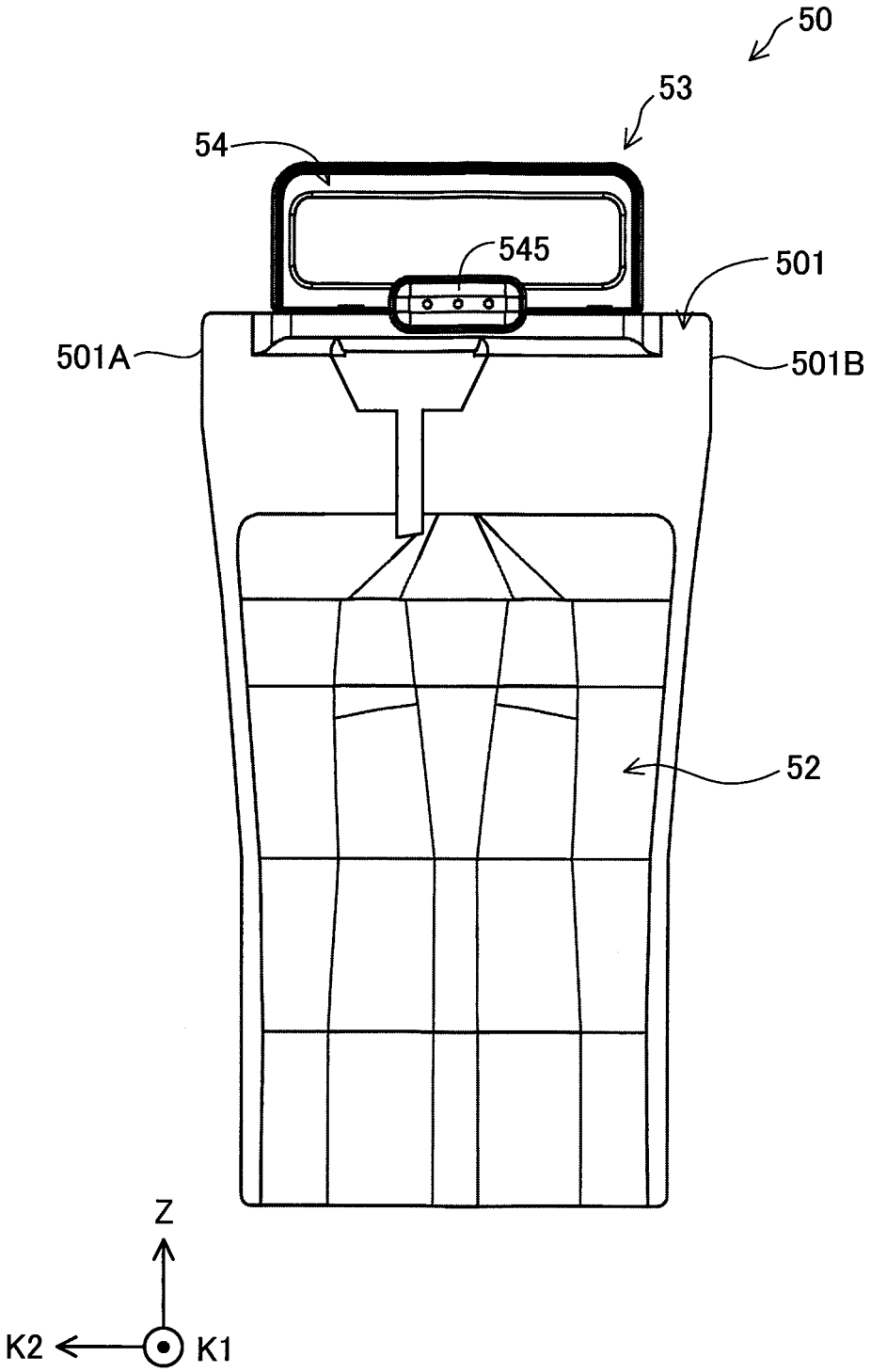
FIG. 9 is a first perspective view illustrating part of the fluid container.
Figure 10:
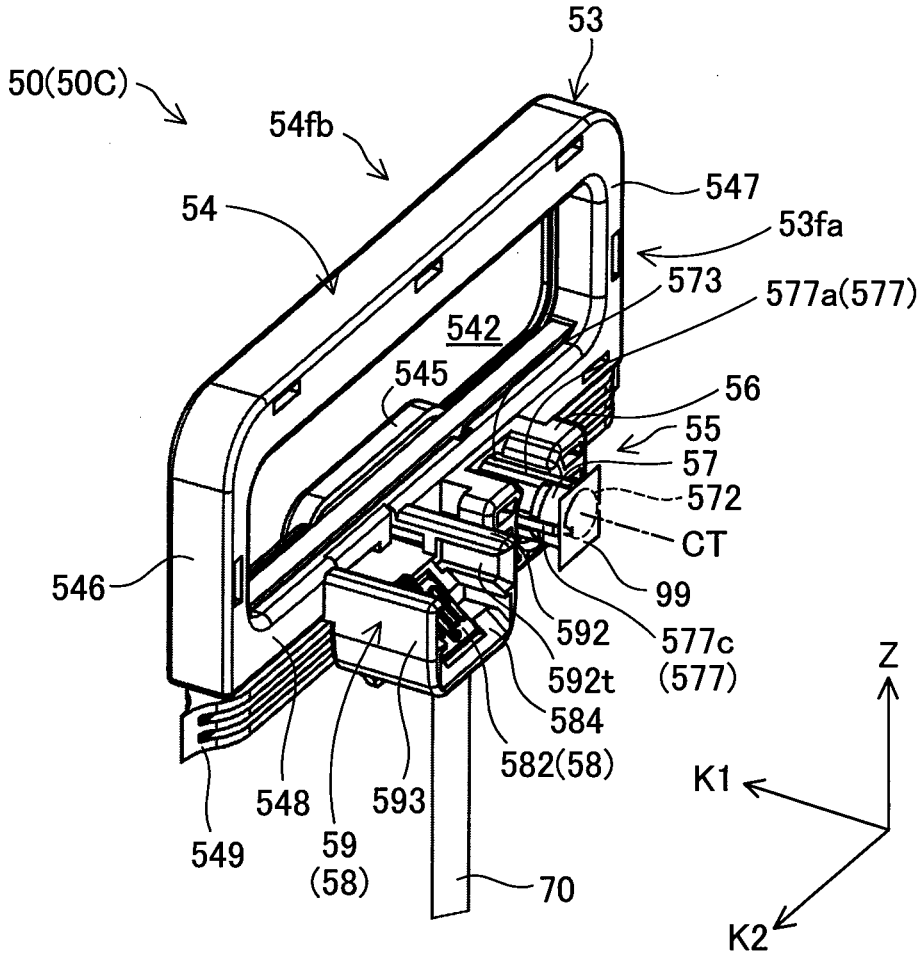
FIG. 10 is a second perspective view illustrating part of the fluid container.
Figure 11:
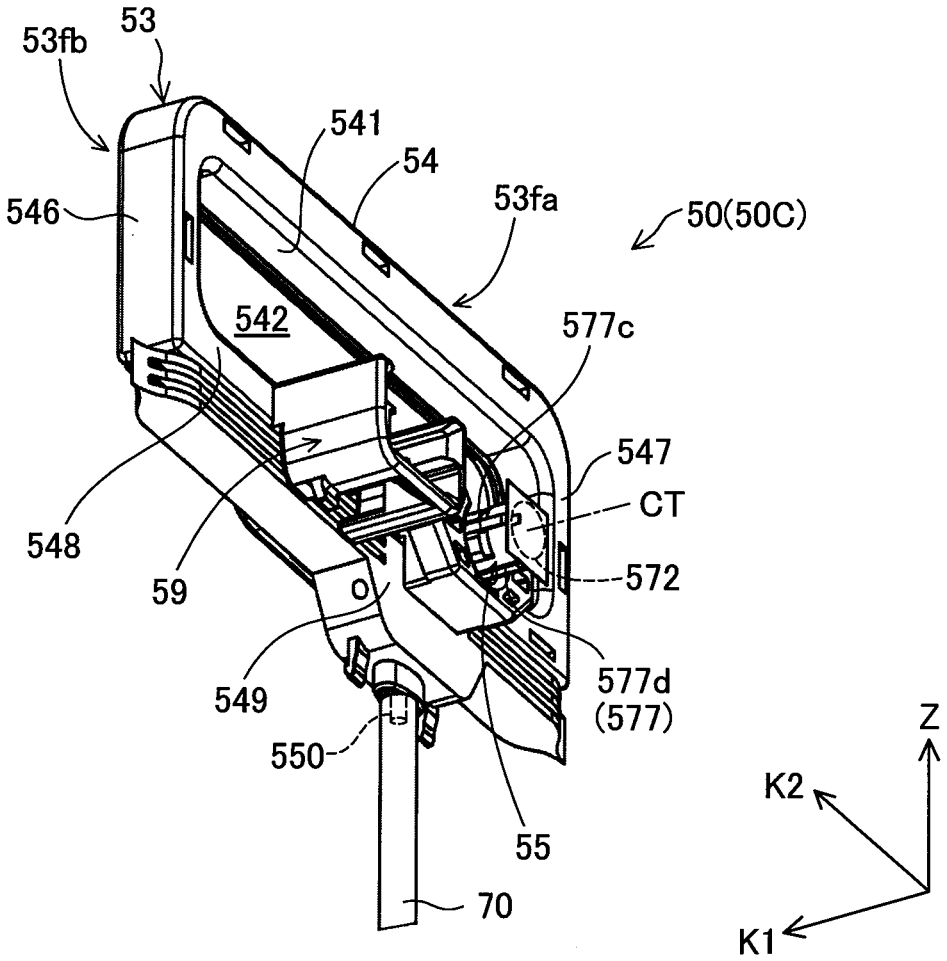
FIG. 11 is a third perspective view illustrating part of the fluid container.
Figure 12:
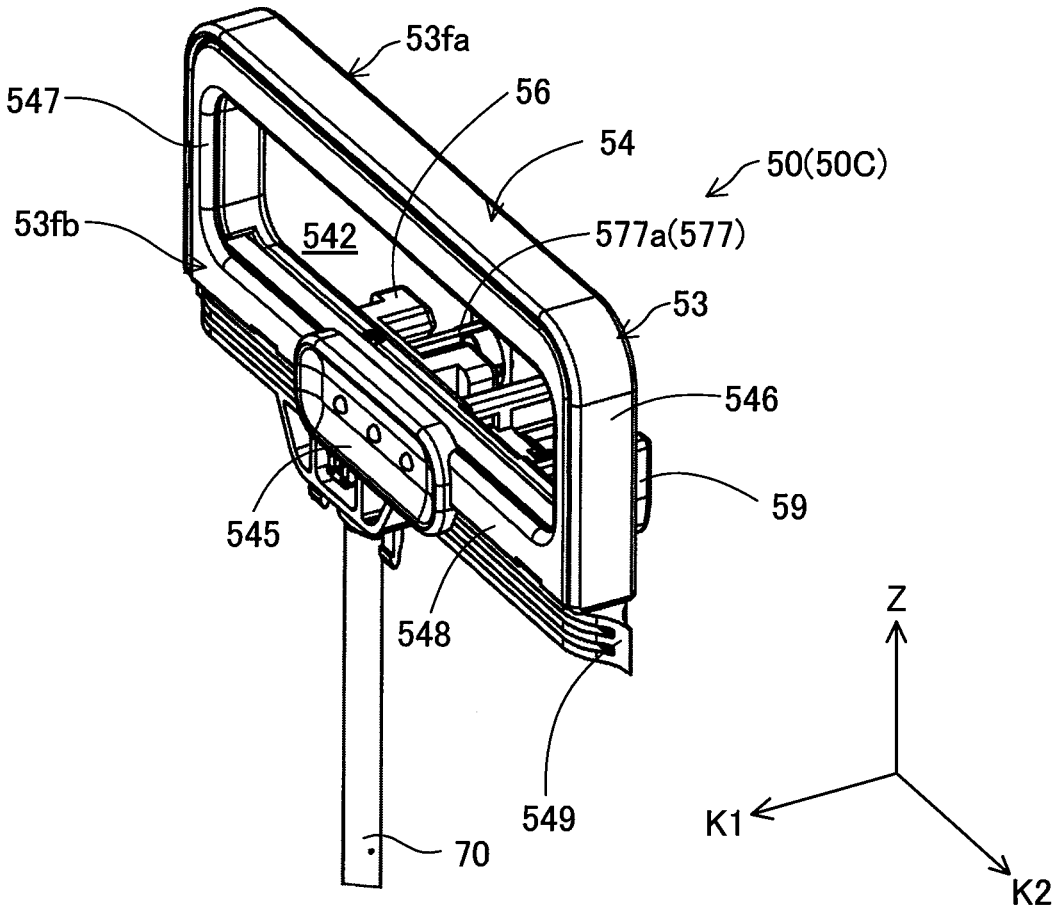
FIG. 12 is a fourth perspective view illustrating part of the fluid container.
Figure 13:
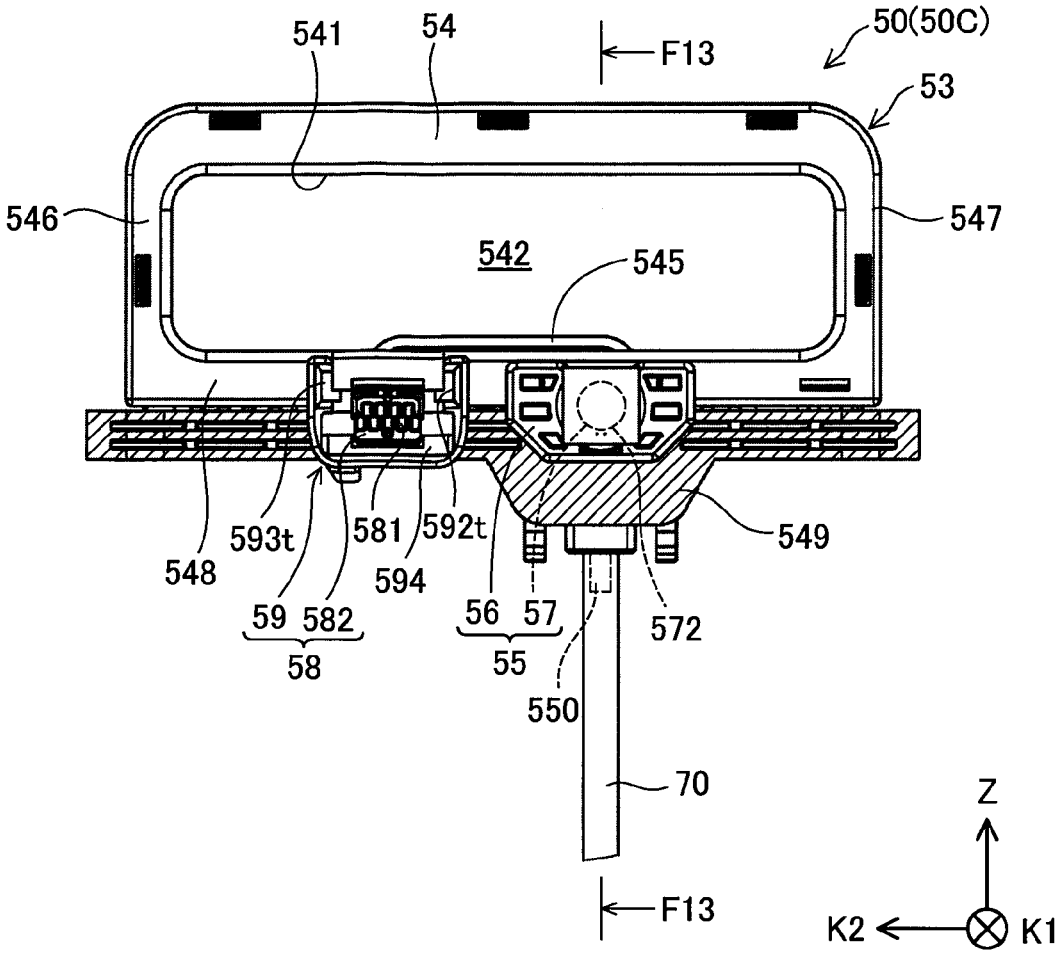
FIG. 13 is a front view illustrating part of the fluid container.
Figure 14:
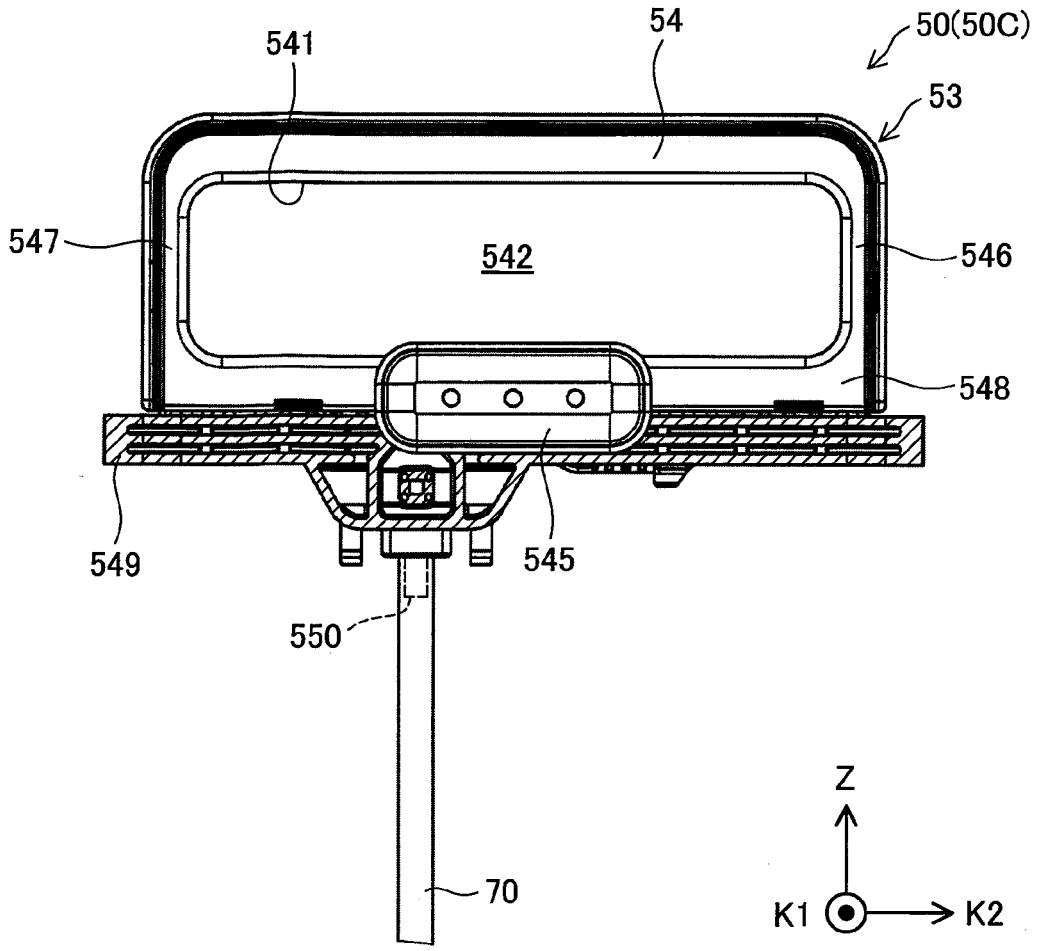
FIG. 14 is a rear view illustrating part of the fluid container.
Figure 15:
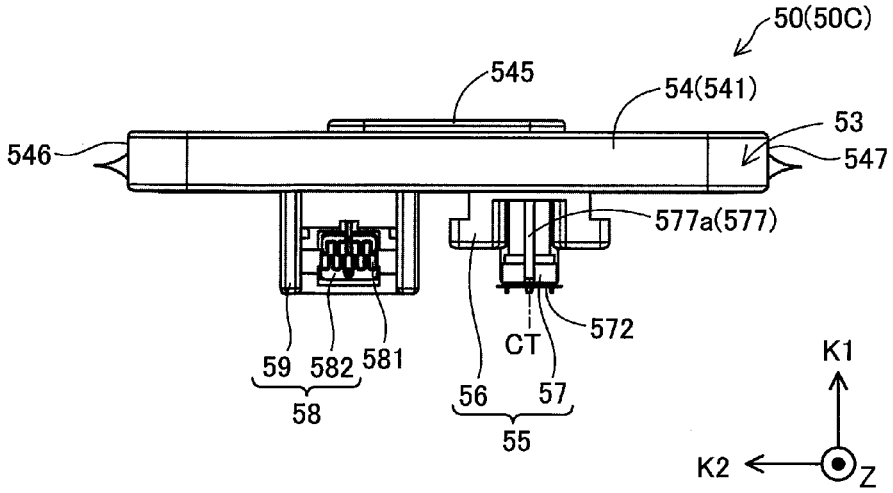
FIG. 15 is a top view illustrating part of the fluid container.
Figure 16:
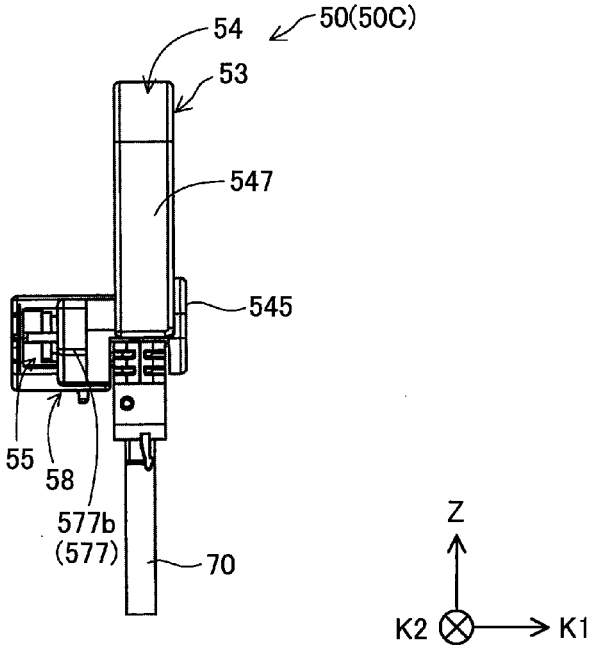
FIG. 16 is a right side view illustrating part of the fluid container.
Figure 16A:
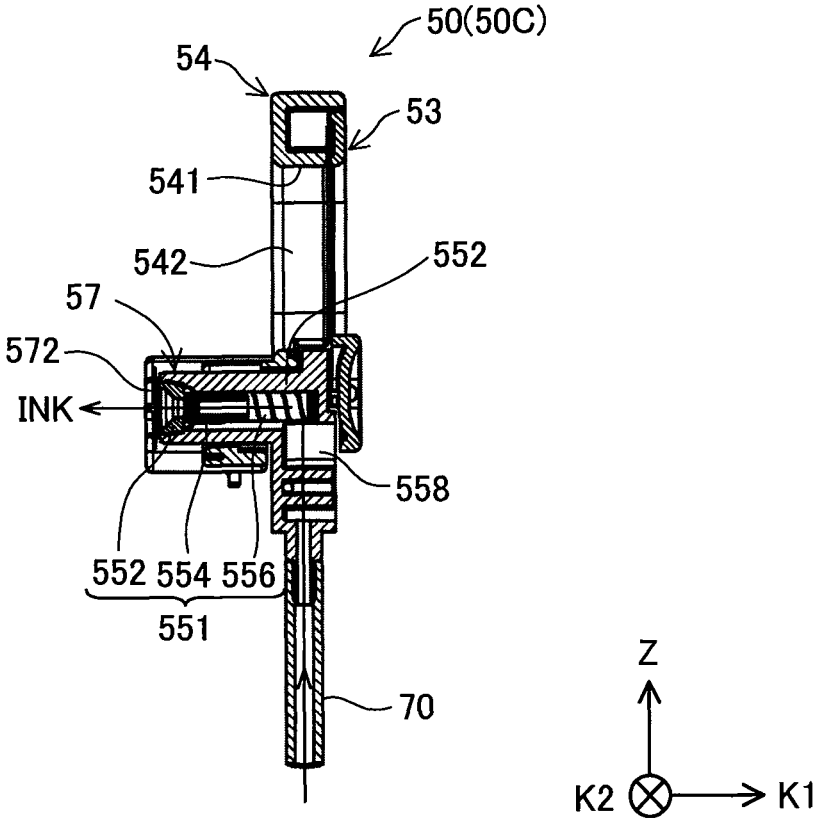
FIG. 16A is an F13-F13 cross sectional view of FIG. 13.
Figure 16B:
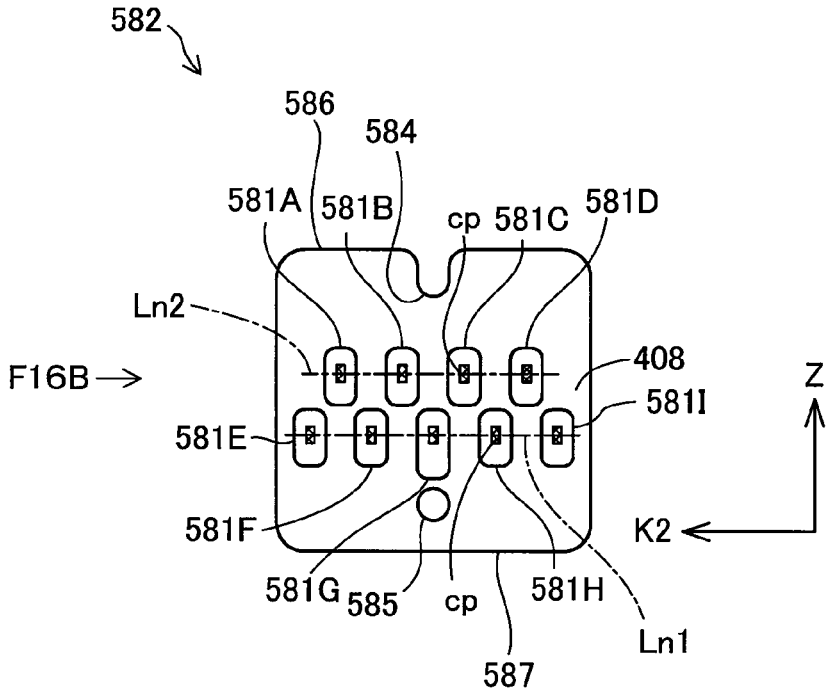
FIG. 16B is a front view illustrating a circuit board.
Figure 16C:
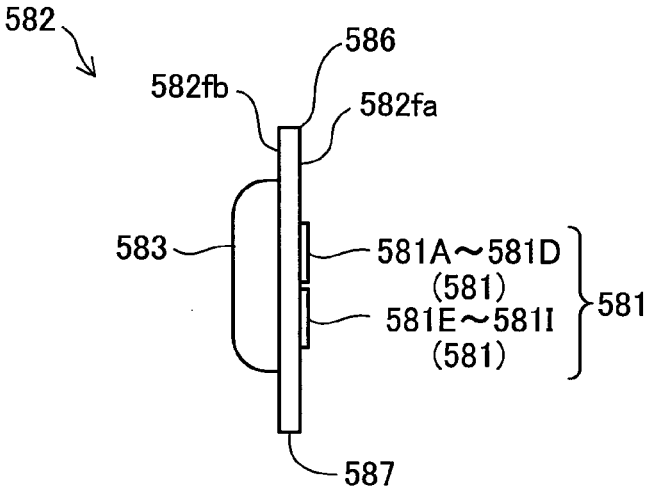
FIG. 16C is a view from an arrow F16B in FIG. 16B.

FIG. 9 is a first perspective view illustrating part of the fluid container 50. FIG. 10 is a second perspective view illustrating part of the fluid container 50. FIG. 11 is a third perspective view illustrating part of the fluid container 50. FIG. 12 is a fourth perspective view illustrating part of the fluid container 50. FIG. 13 is a front view illustrating part of the fluid container 50. FIG. 14 is a rear view illustrating part of the fluid container 50. FIG. 15 is a top view illustrating part of the fluid container 50. FIG. 16 is a right side view illustrating part of the fluid container 50. FIG. 16A is an F13-F13 cross sectional view of FIG. 13. FIG. 16B is a front view illustrating the circuit board 582. FIG. 16C is a view from an arrow F16B in FIG. 16B. In FIGS. 9 to 16A, the fluid container body 52 of the fluid container 50 is omitted from the illustration.

As shown in FIGS. 9 and 10, the operation member (handle member) 53 has the grip section 54, a first connecting section 546, a second connecting section 547, a base section (linkage part) 548 and the attachment section 549. With respect to the operation member 53, the Z-axis direction is also called "height direction", the K1-axis direction is also called "thickness direction", and the K2-axis direction is also called "width direction". The attachment section 549 may be regarded as a component of the operation member 53 as described above, or alternatively the operation member 53 and the attachment section 549 may be regarded as separate components.

The grip section 54, the first connecting section 546, the second connecting section 547 and the base section 548 are all formed in rod-like shape. The grip section 54, the first connecting section 546, the second connecting section 547 and the base section 548 form a frame-like member. This accordingly forms an approximately rectangular insertion space 542 to accept the user's hand in the operation member 53.

The grip section 54 is a part that can be grasped. More specifically, the grip section 54 is a part grasped by the user to hold the fluid container 50. The grip section 54 is extended along the K2-axis direction. As shown in FIG. 11, the grip section 54 has a grip surface (support surface) 541 that is in contact with the insertion space 542. The grip surface 541 is a part directly held (grasped) by the user. The grip surface 541 is a plane approximately perpendicular to the Z-axis direction in the mounting state that the fluid container 50 is mounted to the mounting assembly unit 30.

As shown in FIG. 9, the first connecting section 546 is a member extended from one end portion of the grip section 54 in the K2-axis direction to the base section 548-side (−Z-axis direction side, fluid container body 52-side shown in FIG. 7). The second connecting section 547 is a member extended from the other end part of the grip section 54 in the K2-axis direction to the base section 548-side (−Z-axis direction side, fluid container body 52-side shown in FIG. 7). The base section 548 is a part opposed to the grip section 54 across the insertion space 542. The base section 548 is extended along the K2-axis direction. A positioning structure 56 described later, a circuit board holding member (container-side electrical connection structure) 59 and a pushing part 545 (shown in FIG. 12) are attached to the base section 548. More specifically, the fluid supply unit 55 and the container-side electrical connection structure 58 (more specifically, the circuit board holding member 59) are linked with each other via the base section 548. The fluid supply unit 55 and the circuit board holding member (contact placement member) 59 accordingly move in conjunction with the motion of the base section 548. This configuration enables the user to operate the motions of the fluid supply unit 55 and the circuit board holding member 59 used for connecting the fluid container 50 to the printer 10 by simply operating the motion of one member (base section 548 in this embodiment). The state of "link" herein means that members to be linked are connected with each other to move in conjunction with each other.

The attachment section (joint part) 549 is located across the base section 548 on the opposite side to the side where the grip section 54 is located. The attachment section 549 is located adjacent to the base section 548. The attachment section 549 is extended along the K2-axis direction. The attachment section 549 is a part which the one end portion 501 of the fluid container body 52 (shown in FIG. 7) is attached to (joined with) by, for example, welding. The attachment section 549 is linked with the operation member 53. As shown in FIGS. 13 and 16A, the attachment section 549 has an outlet element 550 configured to flow the ink contained in the fluid container body 52 to the fluid supply structure 57. A flow path member 70 is connected with the outlet element 550, so that the ink flowing in the flow path member 70 flows through the outlet element 550 to the fluid supply structure 57. In order to facilitate understanding, the part of the attachment section 549 which the fluid container body 52 is attached to is shown by single-hatching in FIGS. 13 and 14.

As shown in FIGS. 9 and 10, the fluid supply unit 55 includes the fluid supply structure 57 and the positioning structure 56. The positioning structure 56 and the fluid supply structure 57 are formed as separate components, and there is a slight gap between the positioning structure 56 and the fluid supply structure 57. The fluid supply unit 55 is provided to be protruded outward (in the −K1-axis direction) from the operation member 53.

The fluid supply structure 57 makes a flow of the ink contained in the fluid container body 52 to the printer 10. The fluid supply structure 57 has a fluid supply port 572 at one end portion and a supply connection part 573 at the other end. The fluid supply port 572 communicates with inside of the fluid container body 52 and flows out the ink contained in the fluid container body 52 to outside (printer 10). The fluid supply port 572 forms a plane perpendicular to the grip surface 541 (plane defined by the Z-axis direction and the K2-axis direction). The supply connection part 573 is connected with the operation member 53. The fluid supply structure 57 is a tubular member (ring-shaped member) extended along the K1-axis direction (direction of center axis CT). The fluid supply structure 57 is provided to be protruded outward (in the −K1-axis direction) from the operation member 53.

The fluid supply structure 57 has a center axis CT, which is parallel to the K1-axis direction. With respect to the K1-axis direction, a direction from the fluid supply port 572 toward the supply connection part 573 is the +K1-axis direction, and a direction from the supply connection part 573 toward the fluid supply port 572 is the −K1-axis direction.

As shown in FIG. 15, the grip surface 541 is placed on the side of the direction (+Z-axis direction) perpendicular to the direction of the center axis CT (K1-axis direction) of the fluid supply structure 57. The operation member 53 including the grip surface 541 is provided to be offset relative to the fluid supply port 572 in the direction of the center axis CT. In other words, when the fluid container 50 is viewed in the direction from the fluid supply structure 57 toward the grip surface 541 (+Z-axis direction), which is orthogonal to the grip surface 541, the fluid supply port 572 is located at a position that does not overlap with the grip surface 541 (operation member 53). Accordingly, the grip surface 541 and the fluid supply port 572 have non-overlapping positional relationship in projection of the fluid container 50 on a plane perpendicular to the grip surface 541.

As shown in FIG. 9, in the unused state of the fluid container 50, the fluid supply port 572 is closed by a film 99. This suppresses leakage of ink through the fluid supply port 572 to outside before the fluid container 50 is mounted to the mounting assembly unit 30 (shown in FIG. 5). The film 99 is broken by the fluid introducing structure 362 (shown in FIG. 5) when the fluid container 50 is mounted to the mounting assembly unit 30.

As shown in FIG. 16A, a valve mechanism 551 is placed inside of the fluid supply structure 57 to open and close a fluid flow path formed by the fluid supply structure 57. The valve mechanism 551 includes a valve seat 552, a valve element 554 and a spring 556. The valve seat 552, the valve element 554 and the spring 556 are placed in the fluid supply structure 57 in this sequence from the fluid supply port 572 toward the supply connection part 573 of the fluid supply structure 57.

The valve seat 552 is an approximately circular member. The valve seat 552 is made of an elastic material such as rubber or elastomer. The valve seat 552 is push in the fluid supply structure 57. The valve element 554 is an approximately cylindrical member. The valve element 554 is placed to close a hole (valve hole) formed in the valve seat 552 in the state before the fluid container 50 is mounted to the mounting assembly unit 30. The spring 556 is a compression coil spring. The spring 556 is arranged to bias the valve element 554 in a direction toward the valve seat 552. In the mounting state of the fluid container 50, the fluid introducing structure 362 (shown in FIG. 5) presses the valve element 554 toward the supply connection part 573, so as to move the valve element 554 toward the supply connection part 573. This motion separates the valve element 554 from the valve seat 552 to set the valve mechanism 551 in the open position. In the open position of the valve mechanism 551, the ink contained in the fluid container body 52 (shown in FIG. 7) may flow out through the flow path member 70, an inner flow path 558 of the operation member 53 and the fluid supply structure 57 to outside.

As shown in FIG. 9, the positioning structure 56 roughly positions the fluid container 50 including the fluid supply port 572 relative to the printer 10 when the fluid container 50 is connected to the printer 10. The positioning structure 56 is integrated with the operation member 53. According to this embodiment, the positioning structure 56 is integrally molded with the operation member 53, so as to be integrated with the operation member 53. The state of "integrated with" herein means that the positioning structure 56 is provided on the operation member 53 to be moved in conjunction with the motion of the operation member 53. According to another embodiment, the positioning structure 56 may be mounted to the operation member 53 by, for example, welding, so as to be integrated with the operation member 53. The positioning structure 56 is provided near the fluid supply port 572 to surround the circumference of the fluid supply port 572 except the top of the fluid supply port 572. In the case that the operation member 53 is made of a material unlikely to be deformed, the positioning structure 56 may be provided at a position of the operation member 53 slightly away from the fluid supply port 572. The positioning structure 56 is protruded from the operation member 53 in the −K1-axis direction.

As shown in FIGS. 9 and 10, the positioning structure 56 is provided in the vicinity of the fluid supply port 572. As shown in FIG. 13, at least part of the positioning structure 56 is provided on the fluid container body 52-side (shown in FIG. 7) (−Z-axis direction side) of the fluid supply port 572. According to this embodiment, the positioning structure 56 is located around the fluid supply structure 57 about the center axis CT. More specifically, the positioning structure 56 is located around the fluid supply structure 57 except the grip section 54-side. The positioning structure 56 is placed inside of the supply structure support portion 42 of the mounting assembly unit 30 (shown in FIG. 5) when the fluid container 50 is connected to the printer 10. A plurality of planes defining the supply assembly support portion 42 (for example, the first support plane 402, the second support plane 403 and the third support plane 404 shown in FIG. 5) abut against the positioning structure 56, so as to restrict the motion of the fluid supply structure 57 and roughly position the fluid container 50. The fluid supply port 572 is then positioned by projections 577 (577*a*, 577*b*, 577*c* and 577*d*) provided in the fluid supply structure 57 at the upper, lower, right and left positions of the fluid supply port 572 and positioning projections 366 (366*a*, 366*b*, 366*c* and 366*d*) provided at the upper, lower right and left positions of the fluid introducing structure 362 shown in FIGS. 5 and 6 and is connected with the fluid introducing structure 362.

The fluid supply unit 55 serves to supply the ink contained in the fluid container body 52 (shown in FIG. 7) to the printer 10. The fluid supply unit 55 may thus be regarded as "fluid supply structure". In this sense, the fluid supply unit 55 as the fluid supply structure includes the fluid supply structure (fluid flow assembly) 57 including the fluid supply port 572 at one end portion thereof, and the positioning structure 56.

As shown in FIGS. 9 and 10, the substrate unit (container-side electrical connection structure) 58 includes the circuit board 582 and the circuit board holding member 59. The substrate unit 58 is provided to be protruded outward (in the −K1-axis direction) from the operation member 53. The protruding direction of the substrate unit 58 is identical with the protruding direction (−K1-axis direction) of the fluid supply structure 57. The protruding direction of the substrate unit 58 may not be necessarily identical with the protruding direction of the fluid supply structure 57 but is only required to be substantially parallel to the protruding direction of the fluid supply structure 57. The state of "substantially parallel" is not limited to completely parallel state but includes almost parallel state including slight error or slight misalignment. In other words, the state of "substantially parallel" includes not-completely parallel state in a range that ensures the advantageous effects described herein. The "plane" herein is not limited to a flat plane but includes a plane with some concavities and convexities and a slightly curved plane. The substrate unit 58 and the fluid supply structure 57 are protruded from the operation member 53 toward the same side (−K1-axis direction side) of the operation member 53.

As shown in FIG. 15, the substrate unit 58 is aligned with the fluid supply unit 55 in the direction parallel to the grip surface 541. More specifically, the substrate unit 58 and the fluid supply unit 55 are aligned in the K2-axis direction that is parallel to the grip surface 541 and is orthogonal to the center axis CT.

As shown in FIG. 9, the circuit board holding member 59 positions the circuit board 582 relative to the printer 10 when the fluid container 50 is connected to the printer 10. The circuit board holding member 59 is integrated with the operation member 53. According to this embodiment, the circuit board holding member 59 is integrally molded with the operation member 53 to be integrated with the operation member 53. The state of "integrated with" herein means that the circuit board holding member 59 is provided on the operation member 53 to be moved in conjunction with the motion of the operation member 53. According to another embodiment, the circuit board holding member 59 may be mounted to the operation member 53 by, for example, welding, so as to be integrated with the operation member 53.

The circuit board holding member 59 is formed in a concave shape that is open on the +Z-axis direction side (i.e., the side where the grip section 54 is located). A concaved bottom 594 is inclined relative to the grip surface 541 (shown in FIG. 11). Mounting the circuit board 582 to the bottom 592 causes the circuit board 582 to be held on the circuit board holding member 59 in the inclined attitude as described above. At least part of the circuit board holding member 59 (bottom 594) is provided on the fluid container body 52-side (shown in FIG. 7) (−Z-axis direction side) of the circuit board 582. In other words, at least part (bottom 594) of the substrate unit (container-side electrical connection structure) 58 other than contact elements cp (shown in FIG. 16B) is provided on the fluid container body 52-side of the contact elements cp.

The circuit board holding member 59 has a first side wall section 592 and a second side wall section 593 extended from the respective sides in the K2-axis direction of the bottom 594 toward the +Z-axis direction. As shown in FIG. 10, the first side wall section 592 has a groove 592*t*. As shown in FIG. 9, the second side wall section 593 has a groove 593*t*. When the fluid container 50 is connected to the printer 10, the circuit board holding member 59 is first supported by the substrate support portion 48 (shown in FIG. 5). This roughly positions the circuit board holding member 59 and the circuit board 582 relative to the device-side terminals 381 (shown in FIG. 5). As the movable member 40 of the mounting assembly unit 30 shown in FIG. 5 moves in the −K1-axis direction, the device-side substrate positioning structure 385 shown in FIG. 6 enters the groove 593*t* (shown in FIG. 9) of the circuit board holding member 59, and the device-side substrate positioning structure 384 (shown in FIG. 6) enters the groove 592*t* (shown in FIG. 10) of the circuit board holding member 59. This positions the circuit board holding member 59 and the circuit board 582 relative to the device-side terminals 381.

As shown in FIG. 13, the circuit board 582 has a plurality of terminals 581 on its surface. According to this embodiment, nine terminals 581 are provided corresponding to the number (nine) of the device-side terminals 381. According to this embodiment, the terminals 581 are in an approximately rectangular shape. A storage unit 583 (shown in FIG. 16B) is placed on the rear face of the circuit board 582. The storage unit 583 stores information regarding the fluid container 50 (for example, the color of ink and the remaining amount of ink). The storage unit 583 is electrically connected with the plurality of terminals 581. In the mounting state, each of the plurality of terminals 581 is electrically connected with the corresponding one of the device-side terminals 381 (shown in FIG. 6) of the electrical connection structure 382 in the printer 10.

As shown in FIG. 16B, a boss groove 584 is formed at an upper end 586 on the +Z-axis direction side of the circuit board 582, and a boss hole 585 is formed at a lower end 587 on the −Z-axis direction side of the circuit board 582. The circuit board 582 is fixed to the bottom (placement element) 594 by means of the boss groove 584 and the boss hole 585.

As shown in FIGS. 16B and 16C, the circuit board 582 has a fluid container-side terminal group 580 provided on a surface 582*fa* and the storage unit 583 provided on a rear face 582*fb*. The surface 582*fa* and the rear face 582*fb* are planes.

The fluid container-side terminal group 580 includes nine terminals 581A to 5811. The storage unit 583 stores information regarding the fluid container 50 (for example, the remaining amount of ink and the color of ink).

As shown in FIG. 16B, the nine fluid container-side terminals 581A to 5811 are respectively formed in approximately rectangular shape and are arranged to form two lines Ln1 and Ln2 at different positions in the Z-axis direction. The lines Ln1 and Ln2 are parallel to the K2-axis direction.

Each of the fluid container-side terminals 581A to 5811 has a contact element cp on its center, which comes into contact with the corresponding device-side terminal 381 (shown in FIG. 6). The above lines Ln1 and Ln2 may be regarded as lines formed by a plurality of contact elements cp. When there is no necessity to distinguish the nine fluid container-side terminals 581A to 5811 from one another, the fluid container-side terminals are expressed by a symbol "581".

As described above, the container-side electrical connection structure 58 has the contact elements cp that come into contact with the device-side electrical connection structure 382. The container-side electrical connection structure 58 is integrated with the operation member 53 as shown in FIG. 9.

As shown in FIG. 15, the grip surface 541 is placed on the side of the direction (+Z-axis direction) perpendicular to the direction of the center axis CT of the fluid supply structure 57. The substrate unit 58 as the container-side electrical connection structure is provided to be offset relative to the operation member 53 including the grip surface 541 in the direction of the center axis CT. In other words, when the fluid container 50 is viewed in the direction (+Z-axis direction) from the fluid supply structure 57 toward the grip surface 541, which is orthogonal to the grip surface 541, the substrate unit 58 is located at a position that does not overlap with the grip surface 541 (operation member 53). Accordingly, the grip surface 541 and the substrate unit 58 have non-overlapping positional relationship in projection of the fluid container 50 on a plane perpendicular to the grip surface 541. It is only required that at least the circuit board 582 of the substrate unit 58 is located at a position that does not overlap with the grip surface 541 (operation member 53).

As shown in FIGS. 9 and 12, a −K1-axis direction side of the operation member 53 is expressed as a first side 53*fa*, and a +K1-axis direction side of the operation member 53 opposite to the first side 53*fa* is expressed as a second side 53*fb*. As shown in FIG. 9, the circuit board holding member 59 and the positioning structure 56 are provided on the same side, i.e., on the first side 53*fa*.

As shown in FIG. 12, the pushing part 545 is provided on the second side 53*fb* that is opposed to the positioning structure 56 and the circuit board holding member 59 across the operation member 53. More specifically, the positioning structure 56 and the circuit board holding member 59 are provided on the surface of the first side 53*fa* of the base section 548 as shown in FIG. 11, the pushing part 545 is provided on the surface of the second side 53*fb* of the base section 548 shown in FIG. 12. As shown in FIGS. 15 and 16, at least part of the pushing part 545 is opposed to the positioning structure 56 and the circuit board holding member 59 across the operation member 53.

The pushing part 545 is a part push by the user when the fluid container 50 is connected to the printer 10. In other words, the pushing part 545 is a manually push part. The pushing part 545 is push in the −K1-axis direction (first direction), so as to move the movable member 40 (shown in FIG. 6) in which the fluid container 50 is set, in the −K1-axis direction.

The pushing part 545 is provided to be protruded outward (in the +K1-axis direction) from the operation member 53. This makes the pushing part 545 more easily distinguishable from the other part and urges the user to press the pressing part 545 when the fluid container 50 is connected to the printer 10. As shown in FIG. 14, when the operation member 53 is viewed in the direction along the K1-axis direction, part of the outer shape of the pushing part 545 is extended beyond the base section 548. This configuration increases the surface area of the pushing part 545 and accordingly facilitates the user to press the pushing part 545.

The operation member 53, the circuit board holding member 59, the positioning structure 56, the fluid supply structure 57 and the pushing part 545 may be made of an identical material or may be made of different materials suitable for the use. For example, a synthetic resin such as polyethylene (PE), polypropylene (PP) or ABS resin may be used for the material of the operation member 53.

Figure 17A:
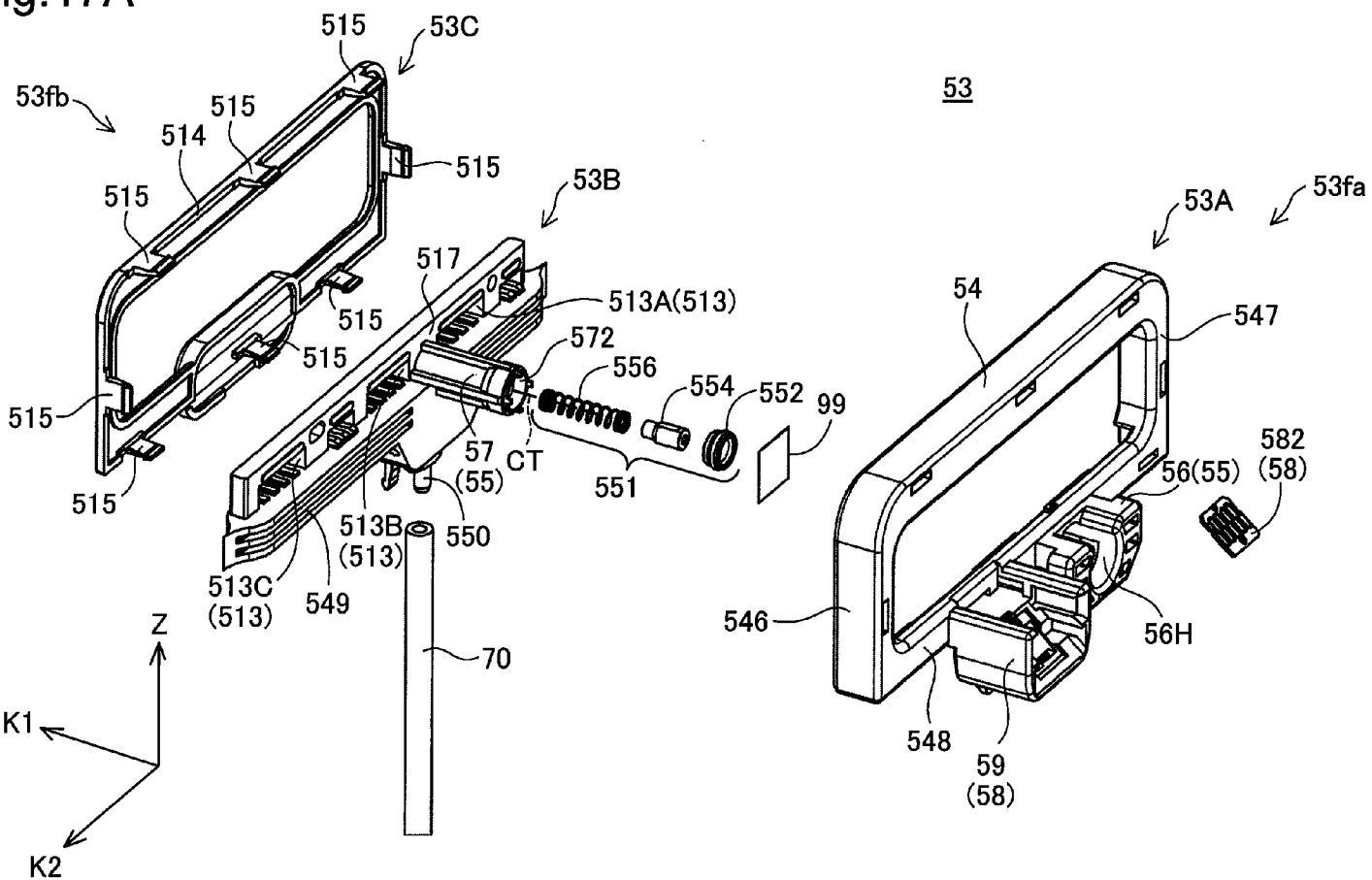
FIG. 17A is a first exploded perspective view illustrating an operation member.
Figure 17B:
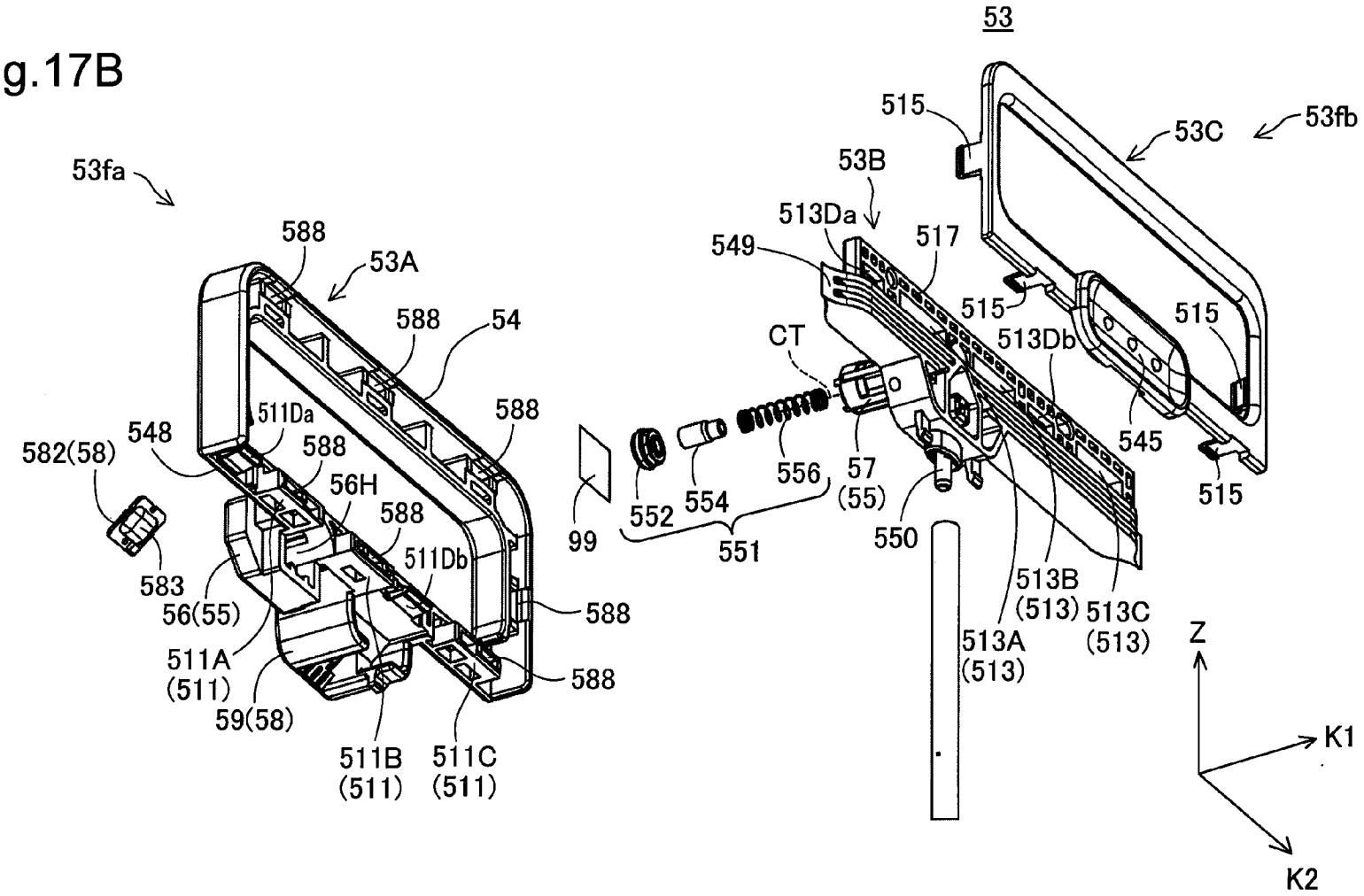
FIG. 17B is a second exploded perspective view illustrating the operation member.
Figure 17C:
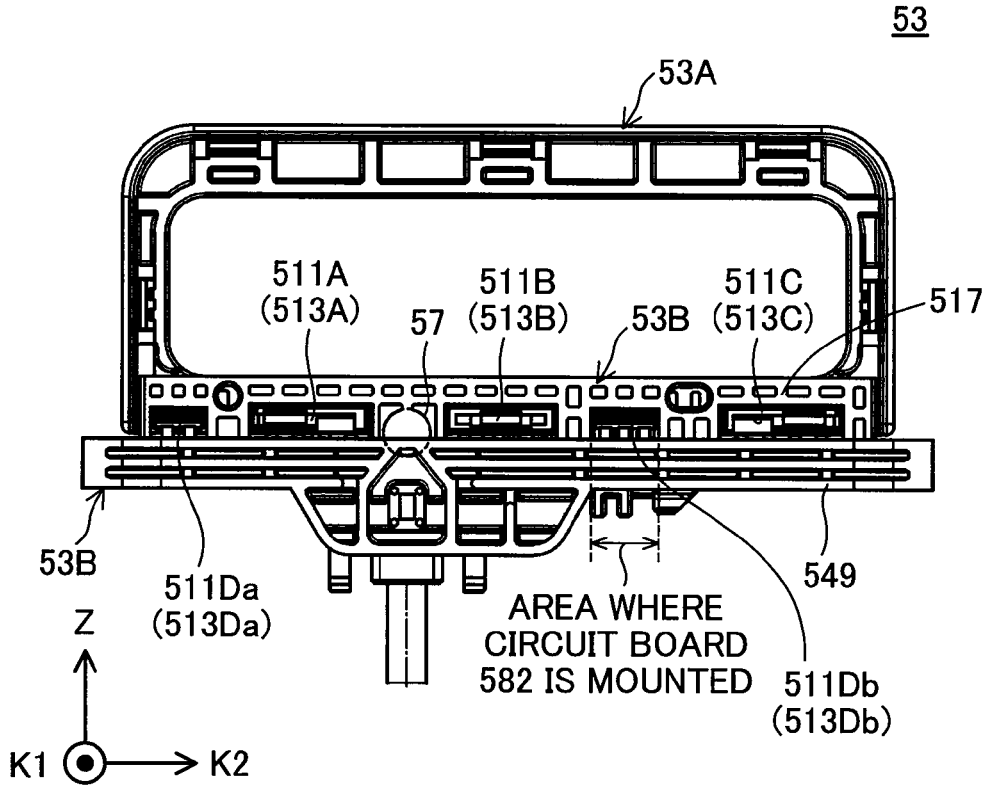
FIG. 17C is a rear view illustrating the operation member.
Figure 17D:
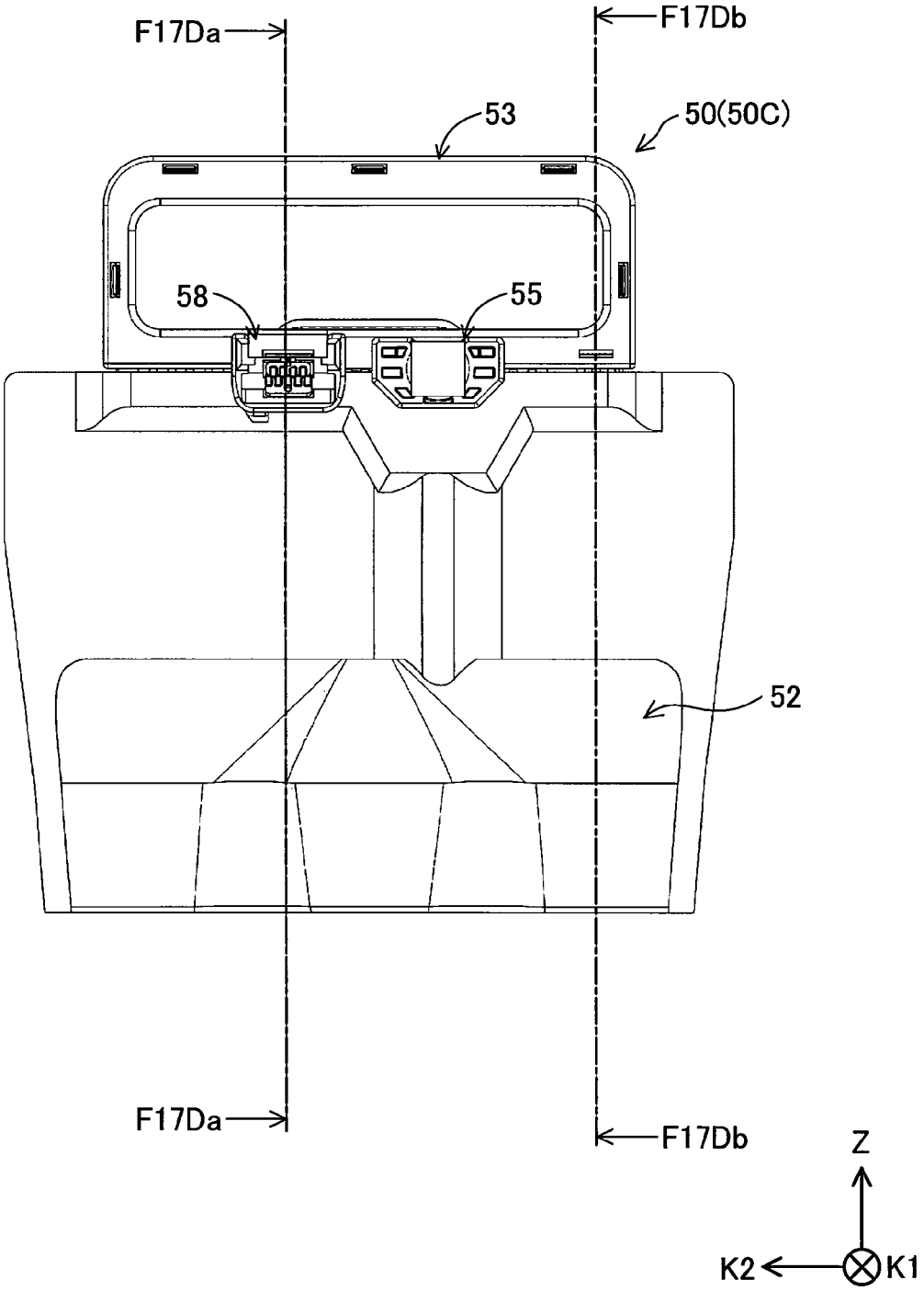
FIG. 17D is a front view illustrating the fluid container.
Figure 17E:
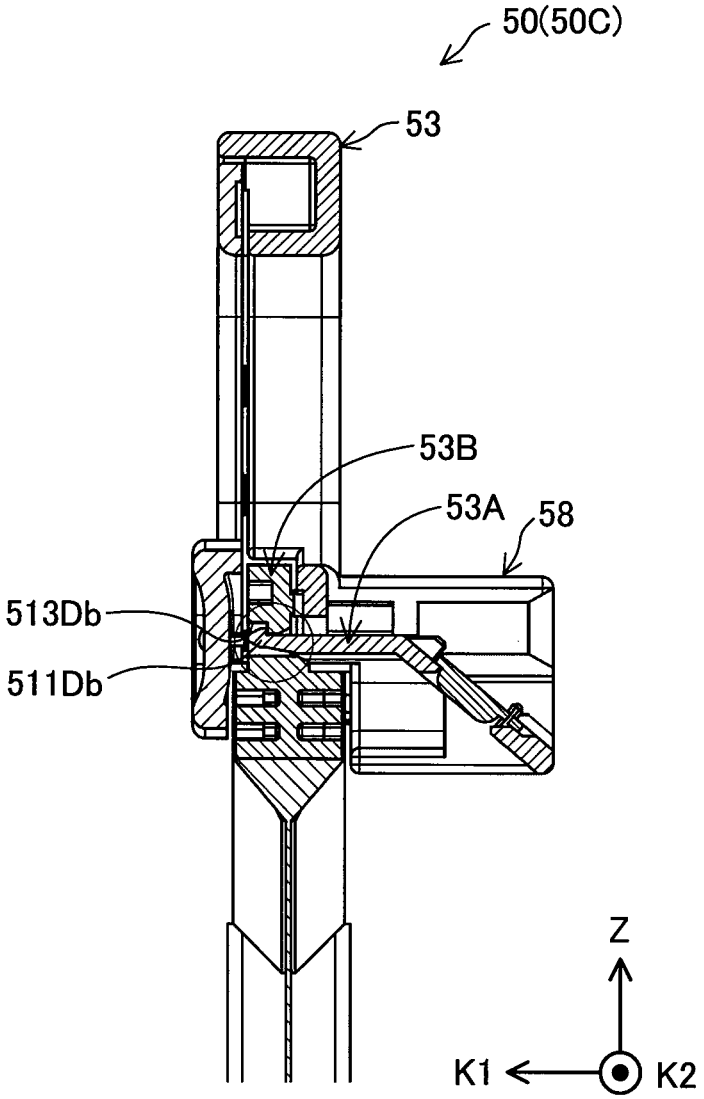
FIG. 17E is an F17Da-F17Da partial cross sectional view of FIG. 17D.
Figure 17F:
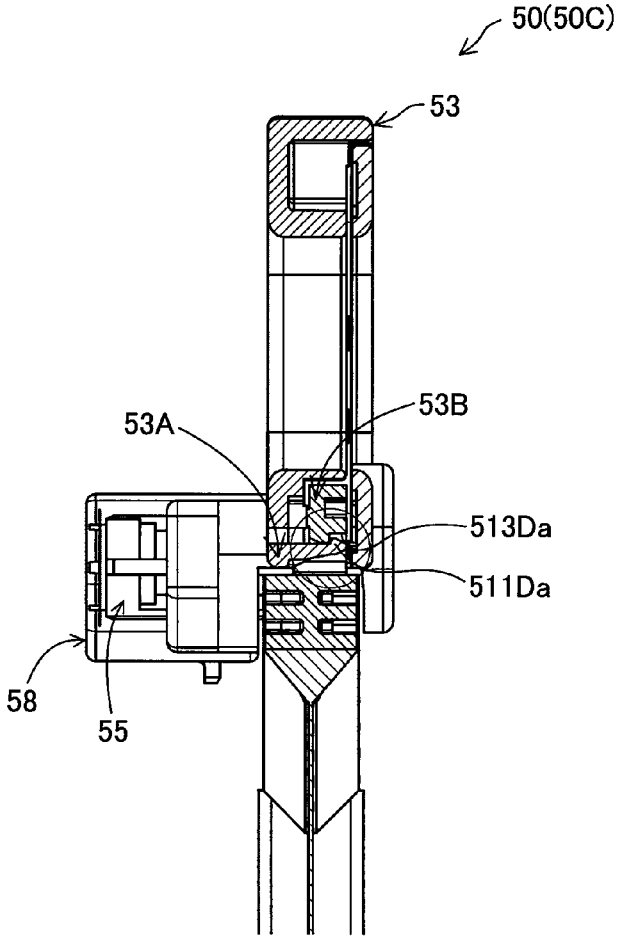
FIG. 17F is an F17Db-F17Db partial cross sectional view of FIG. 17D.
Figure 17F:
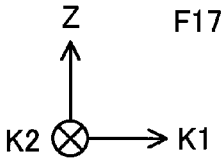

FIG. 17A is a first exploded perspective view illustrating the operation member 53. FIG. 17B is a second exploded perspective view illustrating the operation member 53. FIG. 17C is a rear view illustrating the operation member 53. FIG. 17D is a front view illustrating the fluid container 50. FIG. 17E is an F17Da-F17Da partial cross sectional view of FIG. 17D. FIG. 17F is an F17Db-F17Db partial cross sectional view of FIG. 17D. The flow path member 70 is also illustrated in FIGS. 17A to 17C, in order to facilitate understanding. FIG. 17C illustrates the state that a third member (pressing member) 53C described below is demounted.

As shown in FIGS. 17A and 17B, the operation member (linkage member, handle member) 53 includes a first member 53A, a second member 53B and a third member 53C. Assembling the first to the third members 53A to 53C forms the operation member 53. More specifically, the respective members 53A to 53C are assembled such that the second member 53B is placed between the first member 53A and the third member 53C. Each of the first to the third members 53A to 53C is formed by integral molding of a material such as a synthetic resin.

The first member 53A includes the grip section 54. The first member 53 is in a frame-like shape. The first member 53A is a plate-like member along a plane perpendicular to the K1-axis direction (direction of the center axis CT). The positioning structure 56 and the circuit board holding member 59 are connected with the linkage part 548 (more specifically, the first side 53*fa*-part of the linkage part 548) by integral molding. Accordingly the first member 53A of the operation member 53 may be regarded as "linkage member 53A" or "handle member 53A".

As shown in FIG. 17B, the first member 53A has three engagement elements 511A, 511B and 511C on the second side 53*fb*, which are to be engaged with the second member 53B and thereby link (connect) the first member 53A with the second member 53B. The three engagement elements 511A, 511B and 511C are aligned along the K2-axis direction (direction in which the positioning structure 56 and the circuit board holding member 59 are aligned). Two or a less number of engagement elements or four or a greater number of engagement elements may replace the three engagement elements 511A, 511B and 511C. When there is no necessity to distinguish among the three engagement elements 511A, 511B and 511C, these engagement elements are expressed by a symbol "511".

The engagement elements 511 are provided in the base section 548 on the second side 53*fb* of the first member 53A. The engagement elements 511 are in an approximately rectangular parallelepiped shape. More specifically, the engagement elements 511 are formed in an approximately rectangular outer shape which is the shape surrounding the direction along the K1-axis direction (direction of the center axis CT of the fluid flow assembly 57). The engagement elements 511 are convexes protruded from the base section 548 toward the second member 53B-side (+K1-axis direction side).

As shown in FIG. 17B, the first member 53A has eight (only seven are illustrated) member engagement elements 588 on the second side 53*fb*, which are to be engaged with the pressing member 53C and thereby link (connect) the first member 53A with the third member 53C.

As shown in FIGS. 17A and 17B, the fluid supply structure 57 is connected with the second member 53B by integral molding. The attachment structure (joint structure) 549 is linked (connected) with the second member 53B by integral molding.

The second member 53B has three engaged elements 513A, 513B and 513C which are engaged with the engagement elements 511, such that the first member 53A is mounted to the second member 53B. When there is no necessity to distinguish among the three engaged elements 513A, 513B and 513C, these engaged elements are expressed by a symbol "513". The number of the engaged elements 513 may be four or a greater number or may be two or a less number.

The three engaged elements 513A, 513B and 513C are provided corresponding to the three engagement elements 511A, 511B and 511C of the first member 53A. The engaged elements 513 are through holes formed to pass through in the K1-axis direction. The engaged elements 513 have an outer shape that allows the corresponding engagement elements 511 to be fit in. More specifically, the engaged elements 513 are formed in an approximately rectangular outer shape which is the shape surrounding the direction along the K1-axis direction (direction of the center axis CT of the fluid flow assembly 57).

As shown in FIG. 17C, fitting the engagement elements 511A, 511B and 511C as the convexes into the engaged elements 513A, 513B and 513C as the through holes causes the second member 53B to be mounted to the first member 53A. A section 517 where the engaged elements 513 are located is also called "protruded portion 517" which is protruded from the joint part 549 to outside of the fluid container body 52 (shown in FIG. 7). The engagement elements 511 of the linkage member 53A are engaged with the engaged elements 513 provided on the protruded portion 517, so that the linkage member 53A is linked with the joint part 549.

The three engagement elements 511A, 511B and 511C of the handle member 53A are engaged with the second member 53B to which the fluid container body 52 is mounted, so as to have the following function. When the user grasps the handle member 53A to hold the fluid container 50, the three engagement elements 511A, 511B and 511C serve as parts receiving the load produced by the own weight of the fluid container body 52. Accordingly, the three engagement elements 511A, 511B and 511C are also called support elements 511A, 511B and 511C.

Assembling the handle member 53A with the second member 53B causes the handle member 53A to be connected with the fluid supply structure 57. The "connected" state described in this paragraph includes not only the configuration that the handle member 53A is directly connected with the fluid supply structure 57 but the configuration that the handle member 53A is indirectly connected with the fluid supply structure 57 via another member.

Engagement between the engagement element 511B and the engaged element 513B restricts the motion of the second member 53B relative to the linkage member 53A in the K2-axis direction and the Z-axis direction. Engagement between the engagement element 511A and the engaged element 513A and engagement between the engagement element 511C and the engaged element 513C restrict the motion of the second member 53B relative to the linkage member 53A in the Z-axis direction. More specifically, the engagement elements 511 and the engaged elements 513 are formed to have the outer shapes surrounding the direction along the direction of the center axis CT (K1-axis direction) and thereby suppress positional misalignment between the linkage member 53A and the second member 53B in the planar direction orthogonal to the direction of the center axis CT (planar direction defined by the Z-axis direction and the K2-axis direction).

As shown in FIG. 17B, the linkage member 53A also has engagement claws 511Da and 511Db in a convex shape. The engagement claws 511Da and 511Db are provided on the second side 53*fb* of the linkage part 548 of the first member 53A. The second member 53B has through holes 513Da and 513Db at positions corresponding to the engagement claws 511Da and 511Db in the convex shape.

As shown in FIGS. 17E and 17F, the engagement claws 511Da and 511Db are locked by members forming the through holes 513Da and 513Db, so as to restrict the motion of the second member 53B relative to the linkage member 53A in the +K1-axis direction. Part of the second member 53B abuts against part of the linkage member 53A, so that the motion of the second member 53B relative to the linkage member 53A in the −K1-axis direction is restricted.

As described above, the engagement elements 511 of the linkage member 53A are engaged with the engaged elements 513 of the second member 53B, so as to position the respective members 53A and 53B relative to each other. The circuit board holding member 59 is linked with the linkage member 53A, and the fluid supply structure 57 to be connected with the printer 10 is linked with the second member 53B. Accordingly, engagement of the engagement elements 511 of the linkage member 53A with the engaged elements 513 of the second member 53B determines the positions of the fluid supply structure 57 and the circuit board holding member 59 relative to each other. The engagement elements 511 are also called "member positioning elements 511".

As shown in FIG. 17C, the engagement element 511A and the engagement element 511B are located at the positions across the fluid supply structure 57 in the longitudinal direction (K2-axis direction) of the joint part 549. The engagement element 511A and the engagement element 511C are located at the positions across the fluid supply structure 57 in the longitudinal direction (K2-axis direction). The engagement element 511B and the engagement element 511C are located at the positions across the circuit board 582 (contact elements cp) in the longitudinal direction (K2-axis direction). The engagement element 511A and the engagement element 511C are located at the position across the circuit board 582 (contact elements cp) in the longitudinal direction (+K2-axis direction).

As shown in FIG. 17B, the third member 53C includes the pushing part 545. The third member 53C is formed in a frame-like shape corresponding to the shape of the first member 53A. The third member 53C is a plate-like member along a plane perpendicular to the K1-axis direction (direction of the center axis CT). Eight engagement elements 515 are provided on the first side 53*fa* of the third member 53C. The number of the engagement elements 515 is not limited to this number. Engagement of the engagement elements 515 with the member engagement elements 588 shown in FIG. 17B causes the first member 53A and the third member 53C to be linked with each other.

The linkage member (handle member) 53A, the second member 53B and the third member 53C are respectively provided as separate members. According to this embodiment, the handle member 53A, the second member 53B and the third member 53C are made of different materials. It is preferable that at least the handle member 53A and the second member 53B are made of different materials.

The handle member 53A is made of a material including excellent deformation resistance or creep resistance. The handle member 53A has sufficient deformation resistance or creep resistance which makes the handle member 53A unlikely to be deformed when the handle member 53A is grasped by the user and receives a load produced by the own weight of the fluid container body 52. The handle member 53A is made of a material having more excellent (higher) deformation resistance than those of the second member 53B and the third member 53C. The handle member 53A is preferably made of a material having more excellent (higher) creep resistance than those of the second member 53B and the third member 53C. The handle member 53A may be made of a material such as ABS resin, heat-resistant ABS resin having the enhanced heat resistance compared with the standard ABS resin or polystyrene (PS). According to this embodiment, the handle member 53A is made of ABS resin. The heat-resistant ABS resin may be a material having a temperature of deflection equal to or higher than 120° C. under load of 1.82 MPa. At least part of the handle member 53A which is connected with the fluid supply structure 57 may be made of a material having excellent deformation resistance or creep resistance.

The deformation resistance may be evaluated using the flexural modulus as the index. The "material having excellent deformation resistance" is, for example, preferably a material having the flexural modulus of or over 1800 MPa according to JIS K 7171, is more preferably a material having the flexural modulus of or over 2000 MPa and is furthermore preferably a material having the flexural modulus of or over 2500 MPa. The "material having excellent deformation resistance" may be a material having the higher flexural modulus according to JIS K 7171 than that of polyethylene.

The creep resistance may be evaluated using, as the index, the amount of deformation (amount of warpage) when a fixed load (for example, 2.8 MPa) is continuously applied to a member made of a specified material. The "material having excellent creep resistance" is preferably a material having the smaller amount of deformation than that of polyethylene when a member in a predetermined shape is formed from the material.

The second member 53B is made of a material having resistance to the ink contained in the fluid container body 52. The second member 53B is made of a material such as polyethylene (PE), polypropylene (PP) or polyacetal (POM).

The state of "having resistance to fluid" may be regarded as the state of "having chemical resistance". The "material having resistance to fluid" denotes a material (member made of the material) that does not react with the fluid when the material is soaked in the fluid. More specifically, the "material having resistance to fluid" denotes a material (member made of the material) that does not produce a predetermined or a greater amount of impurities such as solid matter in the fluid when the material is soaked in the fluid. For example, the "material having resistance to fluid" may be evaluated by the following procedure. A member made of a target material to be evaluated (second member 53B in this embodiment) is left under a high-temperature environment (for example, at 80° C.) for a predetermined time (for example, 48 hours) after the member is soaked in the ink contained in the fluid container body 52. After the second member 53B is left for the predetermined time, the second member 53B is observed with respect to the following three points:

(i) the presence or non-presence of a solid matter in ink;

(ii) whether a change in mass of the second member 53B before and after the second member 53B is soaked in the ink is within the range of ±5%; and (iii) a change or no change in external shape of the second member 53B.

The material having no solid matter in the ink, no significant change in mass (within ±5%) and no significant change in external shape with respect to the above points (i) to (iii) is evaluated as the "material having resistance to fluid". At least part of the second member 53B that is in contact with the ink (i.e., the inner surface of the fluid supply structure 57) may be made of a material having resistance to the ink.

As shown in FIGS. 17A and 17B, the third member 53C is made of a material such as polyethylene (PE), polypropylene (PP) or polyacetal (POM). The pushing part 545 provided in the third member 53C is located on the opposite side to the fluid supply structure 57 across the handle member 53A. The third member 53C is colored in the color of the ink contained in the fluid container body 52. For example, the third member 53C of the fluid container 50Y containing yellow ink is colored in yellow. Herein "being colored in the color of ink" includes being colored in the same type of color as the color of ink. The "same type of color" may be a similar color in such a range that allows the user to identify the color of the contained ink by visually recognizing the third member 53C. As described above, the "same type of color" means, for example, colors including hue difference of 0 to 3 in the 20-color hue wheel (modified Munsell color wheel) employed in JIS standard (JIS Z 8102).

As described above, the third member 53C serves as an identification area colored in the color of the ink contained in the fluid container body 52 (contained ink). The identification area (colored area) may not be necessarily the entire third member 53C but may be part of the third member 53C which is visible from outside. For example, at least part of the pushing part 545 of the third member 53C may be the identification area.

The third member 53C may be colored in the same color as the color of the contained ink, in order to allow the user to identify the color of the contained ink. This is, however, not restricted. It is only required that the third member 53C has a specific appearance that allows for identification of the color of the contained ink. For example, the color of ink may be displayed in the form of character information on the surface of the pushing part 545.

The connection member 40 (shown in FIG. 5) is also identified by the color of the contained ink. The third member 53C may thus be regarded to have the colored area colored in the same color as that of the connection member 40 to be connected with the fluid container 50. According to this embodiment, the colored area is the entire third member 53C. Part of the third member 53C (for example, at least part of the pushing part 545) may have the colored area.

A-4. Mounting Method of Fluid Container 50 to Mounting Assembly Unit 30

Figure 18:
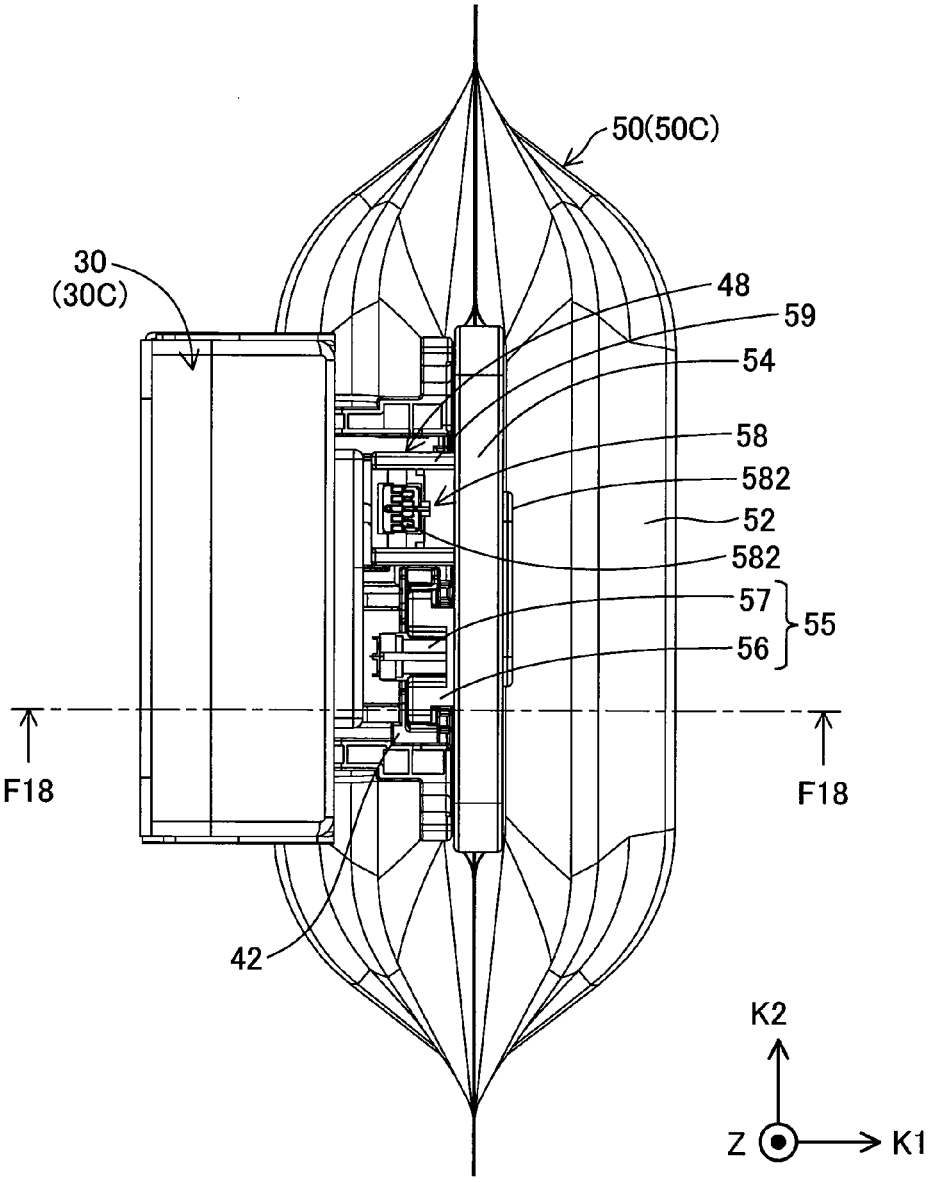
FIG. 18 is a diagram illustrating the state that the fluid container is set in the mounting assembly unit.
Figure 19:
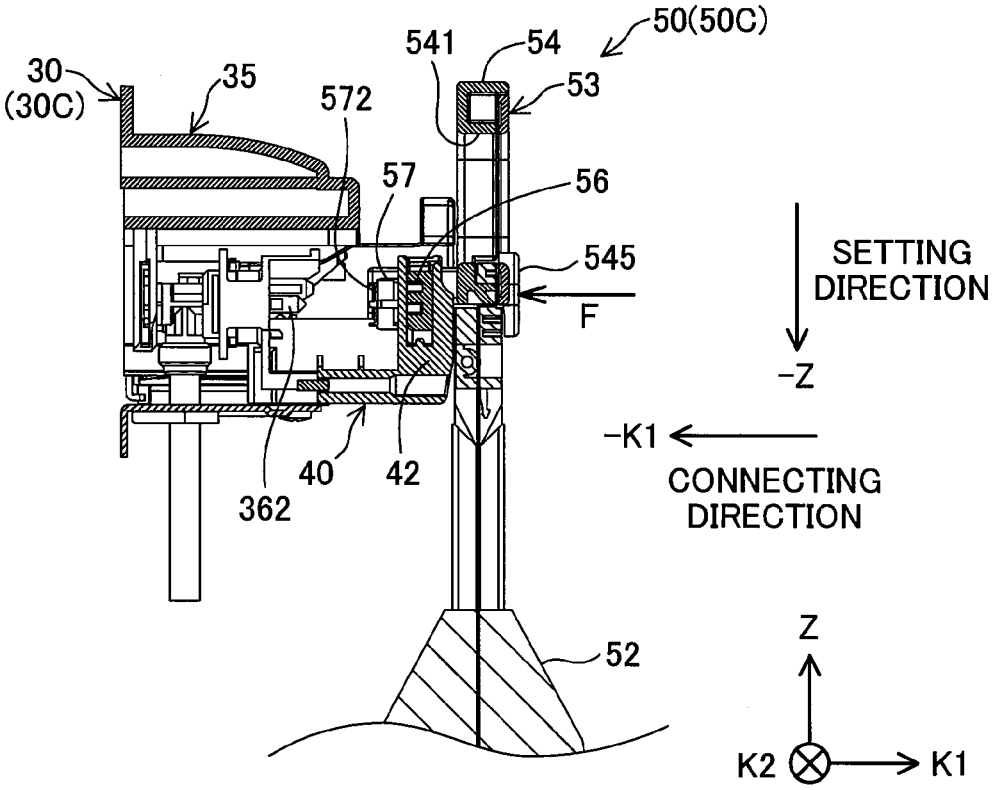
FIG. 19 is an F18-F18 partial cross sectional view of FIG. 18.
Figure 20:
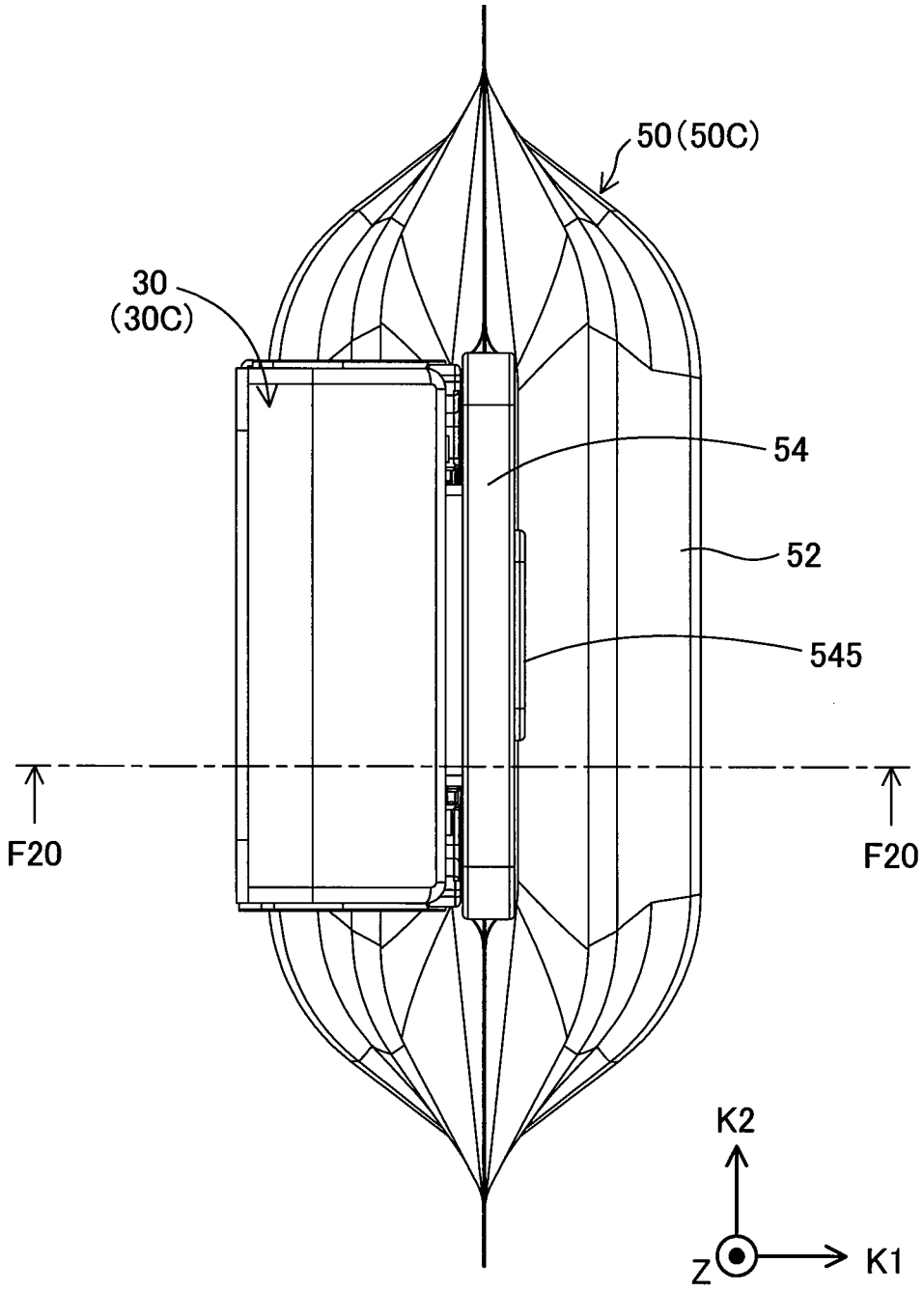
FIG. 20 is a diagram illustrating the state that the fluid container is mounted to the mounting assembly unit.
Figure 21:
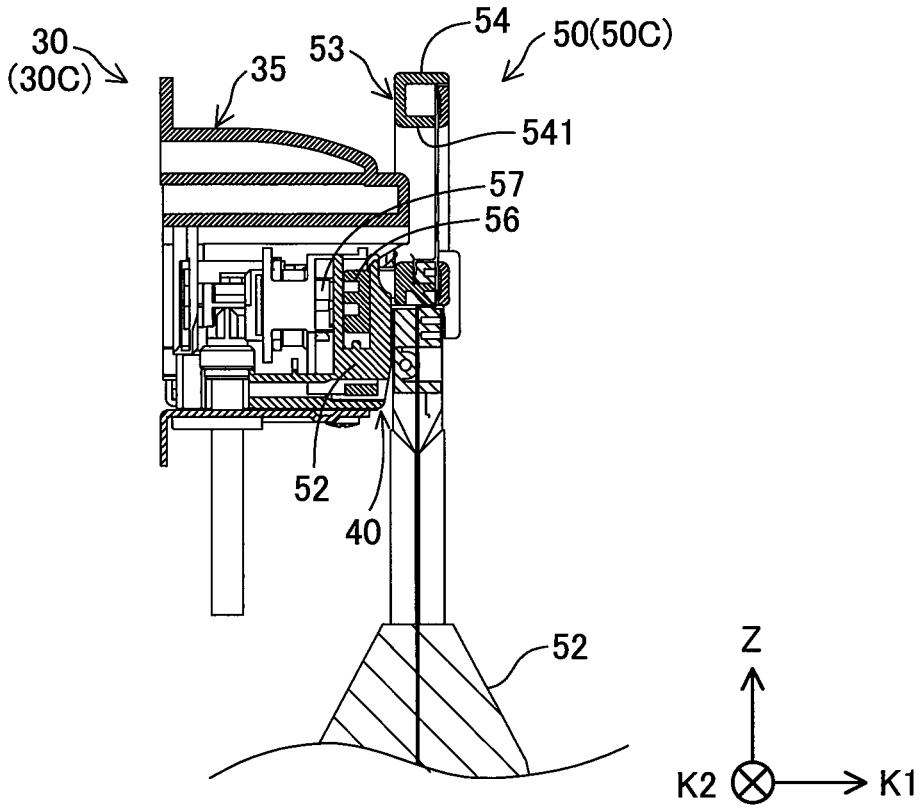
FIG. 21 is an F20-F20 cross sectional view of FIG. 20.

FIG. 18 is a diagram illustrating the state that the fluid container 50 is set in the mounting assembly unit 30. FIG. 19 is an F18-F18 partial cross sectional view of FIG. 18. FIG. 20 is a diagram illustrating the state that the fluid container 50 is mounted to the mounting assembly unit 30. FIG. 21 is an F20-F20 cross sectional view of FIG. 20. The state shown in FIGS. 18 and 19 is the first state like FIG. 5. The state shown in FIGS. 20 and 21 is the second state like FIG. 6.

As shown in FIG. 19, the process of mounting the fluid container 50 to the mounting assembly unit 30 includes two operations, i.e., an operation of moving the fluid container 50 in the setting direction (setting operation or first operation) and an operation of moving the fluid container 50 in the connecting direction (connecting operation or second operation). The setting direction is a direction including a vertically downward (−Z-axis direction) component. According to this embodiment, the setting direction is the vertically downward direction.

The user sets the fluid container 50 in the movable member 40 of the mounting assembly unit 30 in the first state. More specifically, the user grasps the grip section 54 in the state that the operation member 53 is located above the fluid container body 52 in the vertical direction. As shown in FIGS. 18 and 19, the positioning structure 56 of the fluid container 50 is placed in the supply structure support portion 42, and the circuit board holding member 59 is placed in the substrate support portion 48.

After setting the fluid container 50 in the movable member 40, as shown by an arrow F in FIG. 19, the user pushes the pushing part 545 in the −K1-axis direction. Accordingly, the fluid container 50 and the movable member 40 are moved in the connecting direction (−K1-axis direction).

As shown in FIG. 21, in the second state of the mounting assembly unit 30 where the movable member 40 is placed in the stationary member 35, the fluid introducing structure 362 (shown in FIG. 19) is inserted in (connected with) the fluid supply structure 57. In the second state, the terminals 581 of the circuit board 582 (shown in FIG. 13) come into contact with the device-side terminals 381 of the electrical connection structure 382 (shown in FIG. 6), so that the circuit board 582 is electrically connected with the electrical connection structure 382.

A-5. Advantageous Effects

In the above embodiment, the positioning structure 56 and the container-side electrical connection structure 58 (circuit board holding member 59) required for connection with the printer 10 are provided integrally with the operation member 53 (as shown in FIG. 9). There is accordingly no necessity to provide any additional component for connecting the fluid container 50 to the printer 10 (for example, a casing to which the fluid container 50 is mounted). This configuration achieves the function of connecting the fluid container 50 to the printer 10 by using a less number of components. The positioning structure 56 and the container-side electrical connection structure 58 (circuit board holding member 59) are provided integrally with the operation member 53. This configuration enables the user to hold the operation member 53 and operate the fluid container 50 in the process of connecting the fluid container (fluid containing bag unit) 50 to the printer 10. This configuration accordingly has the better operability than the configuration without the operation member 53.

There is also no necessity to mount the fluid container 50 to a casing in advance. This simplifies the process of connecting the fluid container 50 to the printer 10. Unnecessity of the casing achieves downsizing of the fluid container 50. Additionally, unnecessity of the casing allows the fluid container body 52 after the ink consumption to be readily folded up compactly and disposed.

In the above embodiment, the fluid container body 52 is mounted to the operation member 53 (as shown in FIG. 7) in the state that the fluid container body 52 is visible from outside of the fluid container 50. This configuration allows the remaining amount of ink contained in the fluid container body 52 to be readily recognized from outside, based on a change in state of the fluid container body 52, for example, a change in volume, a change in shape or a change in amount of ink.

In the above embodiment, the positioning structure 56 and the circuit board holding member 59 are provided on the first side 53*fa* of the operation ember 53, and the pushing part 545 is provided on the second side 53*fb* which is the opposite side of the operation member 53 to the positioning structure 56 and the circuit board holding member 59 (as shown in FIGS. 9 and 12). This configuration causes the positioning structure 56 and the circuit board holding member 59 which are used to position the fluid container 50 relative to the printer 10 and the pushing part 545 which is to be push for connection of the fluid container 50 to the printer 10, to be readily visible from outside. Accordingly this facilitates the connecting operation of the fluid container 50 to the printer 10.

In the event that the fluid container 50 is accidentally dropped down, there is a likelihood that the fluid container 50 falls in the attitude that the fluid container body 52 of the larger weight containing ink is below the operation member 53. In the above embodiment, at least part of the positioning structure 56 is provided on the fluid container body 52-side (−Z-axis direction side) of the fluid supply port 572 (as shown in FIGS. 7 and 13). This configuration of the positioning structure 56 reduces the likelihood that the fluid supply port 572 collides with an object such as ground even in the event of a drop of the fluid container 50. This accordingly reduces the likelihood that the fluid supply port 572 is damaged.

In the above embodiment, at least part of the circuit board holding member 59 is provided on the fluid container body 52-side (−Z-axis direction side) of the circuit board 582 (as shown in FIGS. 7 and 13). This configuration of the circuit board holding member 59 reduces the likelihood that the circuit board 582 collides with an object such as ground even in the event of a drop of the fluid container 50. This accordingly reduces the likelihood that the circuit board 582 is damaged.

In the above embodiment, the operation member 53 is arranged to offset the grip surface 541 relative to the fluid supply port 572 in the direction of the center axis CT (as shown in FIG. 15) when the grip surface 541 is placed relative to the fluid supply structure 57 in the direction (+Z-axis direction) perpendicular to the direction of the center axis CT of the fluid supply structure 57. This configuration prevents the fluid supply port 572 from being hidden by the operation member 53 but causes the fluid supply port 572 to be visible when the user holds the grip section 54 of the operation member 53 to mount the fluid container 50 to the printer 10. This enables the user to readily mount the fluid container 50 to the printer 10. The user holds the operation member 53 to handle the fluid container 50. This reduces the likelihood that the user touches the fluid container body 52. This accordingly reduces the likelihood that the fluid container body 52 is damaged to cause leakage of the ink contained inside of the fluid container body 52.

In the above embodiment, the fluid supply unit 55 is provided to be protruded outward (−K1-axis direction) from the operation member 53 (as shown in FIGS. 9 and 10). This configuration enables the user to readily recognize the protruding direction of the fluid supply unit 55 as the connecting direction for connecting the fluid container 50 to the printer 10 (shown in FIG. 9). This accordingly enables the user to more readily mount the fluid container 50 to the printer 10.

In the above embodiment, the fluid container 50 has the positioning structure 56 (shown in FIG. 9). The positioning structure 56 roughly positions the fluid container 50 including the fluid supply structure 57 relative to the printer 10. This enables the fluid container 50 to be mounted to the printer 10 in the appropriate state (adequate mounting state).

In the above embodiment, the substrate unit 58 is arranged to be offset relative to the grip surface 541 when the grip surface 541 is placed in the direction (+Z-axis direction) perpendicular to the direction of the center axis CT of the fluid supply structure 57 (as shown in FIG. 15). This configuration causes the substrate unit 58 to be visible when the user holds the grip surface 541 of the operation member 53 to mount the fluid container 50 to the printer 10. This accordingly enables the user to more readily mount the fluid container 50 to the printer 10.

In the above embodiment, the protruding direction of the substrate unit 58 (−K1-axis direction) is identical with the protruding direction of the fluid supply structure 57 (−K1-axis direction) (as shown in FIGS. 9 and 10). This configuration makes the user more likely to recognize the substrate unit 58 and the fluid supply structure 57 simultaneously in the process of mounting the fluid container 50 to the printer 10. This facilitates connection of the fluid supply structure 57 with the printer 10 and electrical connection of the substrate unit 58 with the printer 10. When the user holds the grip surface 541 of the operation member 53 to mount the fluid container 50 to the printer 10, as shown in FIG. 19, this configuration enables the user to recognize that the connecting direction (−K1-axis direction) of the substrate unit 58 to the printer 10 is identical with the connecting direction (−K1-axis direction) of the fluid supply structure 57 to the printer 10. This enables the user to more readily mount the fluid container 50 to the printer 10. Additionally, connecting the fluid supply structure 57 with the printer 10 also achieves electrical connection of the substrate unit 58 with the printer 10.

In the above embodiment, the substrate unit 58 and the fluid supply unit 55 are aligned in the K2-axis direction which is the direction parallel to the grip surface 541 and perpendicular to the center axis CT (as shown in FIGS. 9 and 10). The respective units 55 and 58 are aligned in the direction orthogonal to the connecting direction (−K1-axis direction). This further facilitates electrical connection of the substrate unit 58 with the electrical connection structure 382 and connection of the fluid supply structure 57 with the printer 10.

In the above embodiment, the fluid supply unit 55 (more specifically the positioning structure 56) is linked with the container-side electrical connection structure 58 (circuit board holding member 59) by means of the linkage member 53A (as shown in FIG. 17A). This configuration cause the fluid supply unit 55 and the circuit board holding member 59 to move in conjunction with the motion of the linkage member 53A when the user holds the grip section 54 to move the linkage member 53A. Since the fluid supply unit 55 and the container-side electrical connection structure 58 (circuit board holding member 59) are moved in conjunction with each other, there is no necessity to independently connect the respective components 55 and 59 with the corresponding mechanisms 36 and 38 of the printer 10

(shown in FIG. 6). This facilitates connection of the fluid supply unit 55 and the circuit board holding member 59 with the printer 10. More specifically, this facilitates connection of the fluid supply structure 57 with the printer 10 and contact of the contact elements cp with the device-side electrical connection structure 382.

The linkage member 53A includes the grip section 54 that can be grasped, so that an external force is likely to be applied to the linkage member 53A and a member joined with the linkage member 53A (for example, the joint part 549). In the above embodiment, as shown in FIG. 17A, the fluid supply structure 57 is integrally molded with the joint part 549. In other words, the fluid supply structure 57 is connected with the joint part 549. As shown in FIG. 17A, the linkage member 53A is assembled with the second member 53B, so as to be linked with the joint part 549. This configuration reduces the likelihood that an external force is applied to part (main part) of the fluid container body 52 other than the area attached to the joint part 549. This accordingly reduces the likelihood that the main part of the fluid container body 52 is damaged and thereby reduces the likelihood of leakage of the ink contained in the fluid container body 52 to outside.

In the above embodiment, as shown in FIG. 17B, the linkage member 53A including the grip section 54 and the second member 53B including the joint part 549 to be attached to the fluid container body 52 are provided as separate components. The linkage member 53A is linked with the second member 53B through engagement of the engaged elements 513 provided on the protruded portion 517 of the second member 53B with the engagement elements 511 provided on the linkage member 53A. Forming the joint part 549 attached to the fluid container body 52 and the linkage member 53A as separate components enhances the flexibility of design. For example, forming the engagement elements 511 of the linkage member 53A in the shape corresponding to the shape of the engaged elements 513 of the second member 53B enables the linkage members 53A of different shapes to be linked with the second member 53B.

In the above embodiment, as shown in FIG. 17B, the engagement elements 511 of the linkage member 53A are engaged with the engaged elements 513 of the second member 53B, so as to position the linkage member 53A and the second member 53B relative to each other. Providing the engagement elements 511 serving as the member positioning elements facilitates positioning of the fluid supply structure 57 and the container-side electrical connection structure 58 (circuit board 582) relative to each other. This ensures connection of the fluid supply structure 57 and the circuit board 582 with the printer 10 with high accuracy. More specifically, this ensures connection of the fluid supply structure 57 with the printer 10 and contact of the contact elements cp with the device-side electrical connection structure 382 with high accuracy.

In the above embodiment, as shown in FIG. 17B, the engagement elements 511 serving as the member positioning elements are formed to have the outer shape (more specifically approximately rectangular shape) surrounding the direction (K1-axis direction) along the center axis CT of the fluid supply structure 57. This configuration suppresses a positional misalignment between the second member 53B where the fluid supply structure 57 is provided and the first member 53A where the circuit board 582 (contact elements cp) is provided in the direction perpendicular to the center axis CT (i.e., in-plane direction defined by the Z-axis direction and the K2-axis direction).

In the above embodiment, as shown in FIG. 17B, the linkage member 53A has the three engagement elements 511A, 511B and 511C aligned in the direction (K2-axis direction) intersecting with the direction of gravity (Z-axis direction). This configuration causes a load produced by the own weight of the fluid container body 52 when the user holds the grip section 54 to be dispersed to the three engagement elements 511A, 511B and 511C. This accordingly reduces the likelihood that the engagement elements 511 are damaged.

In the above embodiment, as shown in FIG. 17C, the engagement element 511A and the engagement element 511B or the engagement element 511A and the engagement element 511C are provided at the positions across the fluid supply structure 57 in the longitudinal direction of the joint part 549 (K2-axis direction). This configuration causes the load produced by the own weight of the fluid container body 52 to be applied to both sides of the linkage member 53A and the second member 53B placed across the fluid supply structure 57. Accordingly this reduces the likelihood that one side (+K2-axis direction side) of the joint part 549 is significantly inclined (significantly deformed) relative to the fluid supply structure 57 compared with the other side (−K2-axis direction side). This suppresses the positional misalignment of the fluid supply structure 57 and thereby enables the fluid supply structure 57 to be connected with the printer 10 with high accuracy.

In the above embodiment, as shown in FIG. 17C, the engagement element 511B and the engagement element 511C or the engagement element 511A and the engagement element 511C are provided at the positions across the circuit board 582 (contact elements cp) in the longitudinal direction of the joint part 549 (K2-axis direction). This configuration causes the load produced by the own weight of the fluid container body 52 to be applied to both sides of the linkage member 53A and the second member 53B placed across the circuit board 582 (contact elements cp). Accordingly this reduces the likelihood that one side (+K2-axis direction side) of the joint part 549 is significantly inclined (significantly deformed) relative to the circuit board 582 (contact elements cp) compared with the other side (−K2-axis direction side). This suppresses the positional misalignment of the contact elements cp and thereby enables the contact elements cp to come into contact with the printer 10 with high accuracy.

In the above embodiment, as shown in FIG. 8A, the width W54 of the grip section 54 is narrower than the width W549 of the joint part 549, and the fluid supply unit 55 and the substrate unit 58 are located between the respective ends 54A and 54B of the grip section 54. This configuration causes the fluid supply unit 55 and the substrate unit 58 to be securely supported by the grip section 54 when the user holds the grip section 54.

In the above embodiment, as shown in FIG. 17A, the handle member 53A and the fluid supply structure 57 are formed as separate components. This enhances the flexibility of design of the fluid container 50. For example, even when there is a necessity to change the material of the fluid supply structure 57 associated with a change in type of the ink contained in the fluid container body 52, there is no necessity to change the material of the handle member 53A. Changing the type of ink may cause, for example, the existing fluid supply structure 57 to be significantly eluted in the replaced ink. In this case, there is a necessity to form the fluid supply structure 57 from a material including chemical resistance to the replaced ink. In the configuration of this embodiment, however, the second member 53B where the fluid supply structure 57 is provided and the handle member 53A where the grip section 54 is provided are separate components, so that there is no necessity to change the material of the handle member 53A. Accordingly the handle member 53A and the fluid supply structure 57 may be formed separately from the materials suitable for the use.

In the above embodiment, the fluid supply structure 57 is made of the material including resistance to the ink contained in the fluid container body 52. This reduces the likelihood that the fluid supply structure 57 is deteriorated (damaged) by the ink. This also reduces the likelihood that impurities are produced in the ink that is to be supplied to the printer 10, due to, for example, elution of part of the fluid supply structure 57 in the ink.

The handle member 53A is the part that is held by the user and thereby directly receives an external force. In the above embodiment, the handle member 53A is made of the material including excellent deformation resistance or creep resistance. This suppresses deformation of the handle member 53A. The positioning structure 56 and the circuit board holding member 59 are connected with the handle member 53A. These components 56 and 59 are important parts serving to position the fluid container 50 relative to the printer 10 in the process of connecting the fluid container 50 to the printer 10. Suppressing deformation of the handle member 53A suppresses the positional misalignment of the respective components 56 and 59 relative to the handle member 53A. This ensures the accurate and secure connection of the fluid container 50 with the printer 10.

In the above embodiment, as shown in FIGS. 15 and 17B, the fluid container 50 has the pushing part 545 at the position opposite to the fluid supply unit 55 across the handle member 53A. This configuration enables the user to readily connect the fluid supply structure 57 with the printer 10 by simply pressing the pushing part 545.

In the above embodiment, as shown in FIG. 17A, the handle member 53A and the third member 53C including the pushing part 545 are provided as separate members. This configuration enhances the flexibility of design of the fluid container 50. For example, this enables the shape and the area of the pushing part 545 to be freely determined, irrespective of the shape and the size of the handle member 53A. This may accordingly locate part of the pushing part 545 at an overlapping position with the fluid container body 52. Locating part of the pushing part 545 at the overlapping position with the fluid container body 52 allows for the effective use of the limited space and ensures a predetermined or greater volume of the fluid container body 52 while increasing the outer shape of the pushing part 545.

In the above embodiment, the pushing part 545 has the appearance for identification of the color of the ink contained in the fluid container body 52. More specifically, in the embodiment, the third member 53C including the pushing part 545 (shown in FIG. 17B) is colored in the color of the ink. This configuration enables the user to readily identify the color of the ink contained in the fluid container body 52 by visually recognizing the third member 53C. When there is a change in color of the ink contained in the fluid container body 52, there is a necessity to replace only the third member 53C. The color of the pushing part 545 is identical with the color of the connection member 40 (shown in FIG. 5). This configuration enables the user to readily identify the connection ember 40 corresponding to the fluid container 50 by visually recognizing the pushing part 545. This reduces the likelihood that a wrong fluid container 50 containing a different color of ink, which is not to be mounted, is mistakenly connected with the printer 10.

B. Modifications

The invention is not limited to the embodiment or the aspects described above but may be implemented by a diversity of other aspects without departing from the scope of the invention. Some examples of possible modification are given below.

B-1. First Modification

In the above embodiment, the fluid container body 52 is made of a material including flexibility. This is, however, not restrictive, and the fluid container body 52 may be made of any material that enables the fluid container body 52 to contain a fluid. For example, the fluid container body 52 may be partly made of a material including flexibility or may be made of a hard material that substantially does not change its volume irrespective of the consumption of the fluid. Forming at least part of the fluid container body (fluid container bag) 52 of the material including flexibility causes the volume of the fluid container body 52 to be varied according to the amount of ink contained in the fluid container body 52.

B-2. Second Modification

In the above embodiment, the operation member 53 is in the frame-like shape (as shown in FIG. 13). The shape of the operation member 53 is, however, not limited to this embodiment but may be any shape that can be grasped by the user. For example, the operation member 53 may be in a rod-like (plate-like) shape extended along the Z-axis direction.

B-3. Third Modification

In the above embodiment, for example, the handle member 53A, the fluid supply unit 55 and the circuit board holding member 59 are formed by assembling the three members 53A, 53B and 53C as shown in FIG. 17B. This configuration is, however, not restrictive. For example, an assembly obtained by assembling the three members 53A, 53B and 53C may be formed integrally. The technique employed for integral forming may be, for example, integral molding or bonding the respective members 53A, 53B and 53C with an adhesive or the like. This facilitates manufacture of the fluid container 50. This allows the fluid supply unit 55 to be integrally formed with the substrate unit 58 and thereby ensures positioning of the respective units 55 and 58 relative to each other with high accuracy. This also allows the joint part 549 to be integrally formed with the linkage member 53A and thereby reduces the likelihood that the joint part 549 is separated from the linkage member 53A by the weight of the fluid container body 52 when the user holds the linkage member 53A. When the user holds the linkage member 53A, a load produced by the own weight of the fluid container body 52 is applied to the linkage member 53A via the joint part 549. This configuration reduces the external force applied to the fluid container body 52 itself and thereby reduces the likelihood that the fluid container body 52 is damaged.

B-4. Fourth Modification

The present invention is not limited to the inkjet printer or its fluid container 50 but is also applicable to any printing device (fluid consuming device) configured to eject another fluid but ink and a fluid container configured to contain another fluid. For example, the invention may be applied to any of various fluid consuming devices and their fluid containers:

(1) image recording device, such as a facsimile machine;

(2) color material ejection device used to manufacture color filters for an image display device, e.g., a liquid crystal display;

(3) electrode material ejection device used to form electrodes of, for example, an organic EL (electroluminescence) display and a field emission display (FED);

(4) fluid consuming device configured to eject a bioorganic material-containing fluid used for manufacturing biochips;

(5) sample ejection device used as a precision pipette;

(6) ejection device of lubricating oil;

(7) ejection device of a resin solution;

(8) fluid consuming device for pinpoint ejection of lubricating oil on precision machines such as watches or cameras;

(9) fluid consuming device configured to eject a transparent resin solution, such as an ultraviolet curable resin solution, onto a substrate in order to manufacture a hemispherical microlens (optical lens) used for, for example, optical communication elements;

(10) fluid consuming device configured to eject an acidic or alkaline etching solution in order to etch a substrate or the like; and

(11) fluid consuming device equipped with a fluid ejection head for ejecting a very small volume of droplets of any other fluid.

The "droplet" herein means the state of fluid ejected from the fluid consuming device and may be in a granular shape, a teardrop shape or a tapered threadlike shape. The "fluid" herein may be any material ejectable by the fluid consuming device. The "fluid" may be any material in the liquid phase. For example, liquid-state materials of high viscosity or low viscosity, sols, aqueous gels and other liquid-state materials having inorganic solvents, organic solvents, solutions, liquid resins and liquid metals (metal melts) are included in the "fluid". The "fluid" is not limited to the liquid state as one of the three states of matter but includes solutions, dispersions and mixtures of the functional solid material particles, such as pigment particles or metal particles, solved in, dispersed in or mixed with a solvent. Typical examples of the fluid include ink described in the above embodiment and liquid crystal. The ink herein includes general water-based inks and oil-based inks, as well as various fluid compositions, such as gel inks and hot-melt inks. In an application using a fluid container configured to contain UV ink curable by LTV radiation and connected with the printer, the arrangement of the fluid container coming off the placement surface reduces the likelihood that the LTV ink is cured by transmission of heat from the placement surface to the fluid container.

B-5. Fifth Modification

In the above embodiment, the container-side electrical connection structure 58 has the circuit board 582. This is, however, not restrictive, but the container-side electrical connection structure 58 may have any configuration including the contact elements cp arranged to come into contact with the device-side electrical connection structure 382. For example, the circuit board 582 may not have the storage unit 583. In another example, the container-side electrical connection structure 58 may have a contact element of a terminal used for detection of mounting and demounting of the fluid container 50. The container-side electrical connection structure 58 may have a circuit board assembly including a flexible cable, such as a flexible printed circuit board (FPC). This circuit board assembly may have contact elements arranged on its one end portion to come into contact with the device-side electrical connection structure 382. The other end of the circuit board assembly may be connected, for example, with a reset device. This modified configuration may be employed, instead of the circuit board 582 or in addition to the circuit board 582.

The invention is not limited to any of the embodiment, the examples and the modifications described herein but may be implemented by a diversity of other configurations without departing from the scope of the invention. For example, the technical features of the embodiment, examples and modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A fluid container detachably connectable with a fluid consuming device, the fluid container comprising:

a fluid container body configured to contain a fluid having a first end portion and a second end portion;

a fluid supply structure located at the first end portion of the fluid container body;

a container-side electrical connection structure including a contact element that comes into contact with a device-side electrical connection structure provided in the fluid consuming device, the container-side electrical connection structure located at the first end portion of the fluid container body; and a linkage member including a linkage part configured to link the fluid supply structure with the container-side electrical connection structure and a handle part that is grasped, wherein the linkage member is located at the first end portion of the fluid container body.

2. The fluid container according to claim 1, further comprising a joint part joined with the first end portion of the fluid container body, wherein the fluid supply structure is connected with the joint part, and the linkage member is linked with the joint part.

3. The fluid container according to claim 1, wherein the fluid supply structure and the linkage member are formed integrally.

4. The fluid container according to claim 1, wherein the fluid supply structure, the container-side electrical connection structure and the linkage member are formed integrally.

5. The fluid container according to claim 2, wherein the joint part includes a protruded portion protruded outside of the fluid container body, the linkage member has an engagement element to be engaged with the protruded portion, and the linkage member is linked with the joint part through engagement of the engagement element with the protruded portion.

6. The fluid container according to claim 5, wherein the linkage member has a member positioning element configured to determine positions of the fluid supply structure and the container-side electrical connection structure relative to each other.

7. The fluid container according to claim 6, wherein the fluid supply structure has a flow assembly including a center axis extended in a predetermined direction, and the member positioning element has an outer shape surrounding a direction along the center axis.

8. The fluid container according to claim 5, wherein the linkage member has a plurality of the engagement elements.

9. The fluid container according to claim 8, wherein the plurality of engagement elements are arranged at positions across the fluid supply structure in a longitudinal direction of the joint part.

10. The fluid container according to claim 8, wherein the plurality of engagement elements are arranged at positions across the contact element in a longitudinal direction of the joint part.

11. A fluid container detachably connectable with a fluid consuming device, the fluid container comprising:

a fluid container body configured to contain a fluid;

a fluid supply structure located at a first end portion of the fluid container body;

a container-side electrical connection structure including a contact element that comes into contact with a device-side electrical connection structure provided in the fluid consuming device;

a linkage member including a linkage part configured to link the fluid supply structure with the container-side electrical connection structure and a handle part that is grasped; and a joint part joined with the first end portion of the fluid container body, wherein the fluid supply structure is connected with the joint part, and the linkage member is linked with the joint part, a width of the handle part along a longitudinal direction at the first end portion of the fluid container body is smaller than a width of the joint part along the longitudinal direction at the first end portion of the fluid container, and the fluid supply structure and the container-side electrical connection structure are located between two ends of the handle part in the longitudinal direction at the first end portion of the fluid container body.

12. The fluid container according to claim 1, wherein the handle part comprises a portion defining a pass-through hole in a direction of push of the linkage member.

13. The fluid container according to claim 1, wherein the first end portion is located above the second end portion of the fluid container body in a mounting state in which the fluid container is mounted to the fluid consuming device and the second end portion is opposed to the first end portion.

14. The fluid container according to claim 1, wherein the linkage member is a frame-like member.

15. The fluid container according to claim 1, wherein the fluid container body is made of a material including flexibility and the fluid container body is not placed in a casing but is made visible from outside.

* * * * *